US006338549B1

(12) United States Patent
Kitahara et al.

(10) Patent No.: US 6,338,549 B1
(45) Date of Patent: Jan. 15, 2002

(54) PIEZOELECTRIC VIBRATOR UNIT, METHOD FOR MANUFACTURING THE SAME, AND INK-JET RECORDING HEAD

(75) Inventors: Tsuyoshi Kitahara; Minoru Usui; Satoru Hosono, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/254,010

(22) PCT Filed: Jun. 26, 1998

(86) PCT No.: PCT/JP98/02874

§ 371 Date: Mar. 1, 1999

§ 102(e) Date: Mar. 1, 1999

(87) PCT Pub. No.: WO66/00252

PCT Pub. Date: Jan. 7, 1999

(30) Foreign Application Priority Data

| | | |
|---|---|---|
| Jun. 27, 1997 | (JP) | 9-187593 |
| Jul. 30, 1997 | (JP) | 9-219258 |
| Jul. 31, 1997 | (JP) | 9-220199 |
| Oct. 8, 1997 | (JP) | 9-291720 |
| Jun. 24, 1998 | (JP) | 10-177886 |

(51) Int. Cl.[7] ..... B41J 2/045
(52) U.S. Cl. ..... 347/70; 347/68
(58) Field of Search ..... 347/72, 68, 71, 347/70

(56) References Cited

U.S. PATENT DOCUMENTS

| | | | | |
|---|---|---|---|---|
| 5,381,171 A | * | 1/1995 | Hosono | 347/72 |

FOREIGN PATENT DOCUMENTS

| | | | | |
|---|---|---|---|---|
| EP | 655333 A1 | * | 5/1995 | 347/68 |
| EP | 0 695 641 A2 | | 2/1996 | B41J/2/14 |
| JP | 4-1052 | | 1/1992 | B41J/2/045 |
| JP | 4-49046 | | 2/1992 | B41J/2/045 |
| JP | 4-99638 | | 3/1992 | B41J/2/045 |
| JP | 404099638 | * | 3/1992 | 347/72 |
| JP | 6-226971 | | 8/1994 | B41J/2/045 |
| JP | 7-108681 | | 4/1995 | B41J/2/045 |
| JP | 7-186383 | | 7/1995 | B41J/2/045 |
| JP | 7-195688 | | 8/1995 | B41J/2/045 |

* cited by examiner

*Primary Examiner*—Thinh Nguyen
(74) *Attorney, Agent, or Firm*—Sughrue Mion, PLLC

(57) ABSTRACT

One side face of a piezoelectric vibrator is fixed to a fixing substrate. A first conductive layer which conducts to a common internal electrode exposed on the side face in the side of the fixing substrate is formed on the front face of the piezoelectric vibrator which is an unfixed face. A second conductive layer which conducts to an individual internal electrode is formed on the front face. A flexible cable is connected to the front face.

45 Claims, 34 Drawing Sheets

PIEZOELECTRIC VIBRATOR UNIT, METHOD FOR MANUFACTURING THE SAME, AND INK-JET RECORDING HEAD

TECHNICAL FIELD

The present invention relates to a piezoelectric vibrator unit wherein internal electrodes are laminated in a direction of a stretching axis, a method of manufacturing the piezoelectric vibrator unit as a pressure generating member.

BACKGROUND ART

In an ink-jet recording head using a piezoelectric vibrator in a longitudinal vibration mode, as disclosed in Unexamined Japanese Patent Publication No. Hei 4-1052, elastic plates are arranged on the back surface of a nozzle plate in which plural nozzles are made at a narrow interval, and a piezoelectric vibrator with the piezoelectric constant of d31 divided corresponding to each pressure generating chamber in a passage forming substrate is touched to the back surface of the elastic plate so that ink from a reservoir is led to the pressure generating chamber via an ink supply port, ink in the pressure generating chamber is pressurized by the piezoelectric vibrator driven according to a recording signal and jetted from a nozzle aperture as an ink droplet.

As such a piezoelectric vibrator with the piezoelectric constant of d31 has a smaller piezoelectric constant, compared with a piezoelectric vibrator with the piezoelectric constant of d33 because a piezoelectric vibrator having the constant d31 utilizes displacement in a direction perpendicular to a direction in which internal electrodes are laminated as well-known, there is a problem that rigidity for bending stress is small and breakage is readily caused in a process for forming a vibrator in predetermined size by cutting one piezoelectric diaphragm by a dicing cutter, a wire saw and others because the above piezoelectric vibrator is formed long and narrowly and constituted as a cantilever that one end is fixed to a supporting substrate and a fixing substrate.

To solve such a problem, as disclosed in Unexamined Japanese Patent Publication No. Hei 6-226971, there is proposed a piezoelectric vibrator wherein common internal electrodes and individual internal electrodes are laminated with piezoelectric material so that the above electrodes are wrapped in a central area and the respective electrodes are exposed only at one end, and each lower end of piezoelectric vibrators with the piezoelectric constant of d33 is attached to a fixing substrate at the same pitch as the arrangement pitch of pressure generating chambers in a passage unit.

Hereby, large displacement by the piezoelectric constant of d33 can be obtained, however, as a conductive layer for supplying a driving signal to the common internal electrodes and the individual internal electrodes is divided into the surface and the back surface of the fixing substrate, there is a problem that the connection of a flexible cable is difficult. In addition, as the bottom of the piezoelectric vibrator is fixed to the fixing substrate, the bonding area is limited to the cross section of the piezoelectric vibrator and thereby the strength of bonding is low.

DISCLOSURE OF THE INVENTION

A piezoelectric vibrator unit according to the present invention comprises: a plurality of piezoelectric vibrators including a vibrational area in which common internal electrodes and individual internal electrodes are laminated so that they are wrapped in a central area in a displacement direction thereof with a piezoelectric material between the both internal electrodes and one end portions of the respective electrodes are exposed only on one of the side faces; a first conductive area which conducts both of common internal electrode which is exposed on the side of the fixing substrate and the other side face of the piezoelectric vibrator via the conductive material; and a second conductive area formed on the other side face of the piezoelectric vibrator to conduct to the individual internal electrode.

Accordingly, one side face of the piezoelectric vibrator can be fixed to the fixing substrate as a bonding face, thereby desired bonding strength can be obtained independent of a cross section of the piezoelectric vibrator. In addition, since the conductive area conducting to the common internal electrodes and the conductive area conducting to the individual internal electrodes are located on the same face, a cable can be connected to the conductive layers on the same face.

Therefore, a first object of the present invention is to provide a piezoelectric vibrator unit wherein a cable can be connected to the surface of a piezoelectric vibrator in an arranging direction thereof, and bonding area between the piezoelectric vibrator and a fixing substrate can be sufficiently secured.

A second object of the present invention is to propose a method of manufacturing the piezoelectric vibrator unit suitable for a recording head.

A third object of the present invention is to provide an ink-jet recording head using the above piezoelectric vibrator unit.

BEST MODE FOR CARRYING OUT THE INVENTION

Embodiments will be described below with reference to the accompanying drawings.

Figure 1:
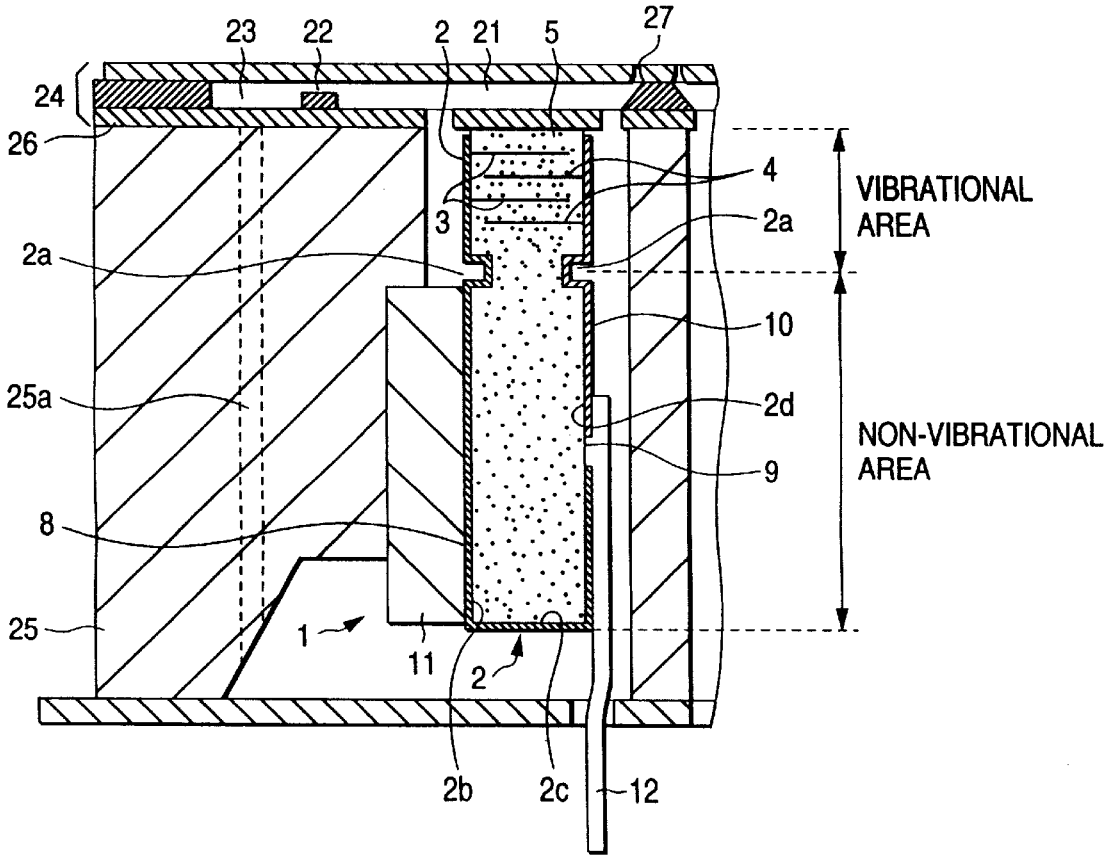
FIG. 1 is a sectional view showing an embodiment of an ink-jet recording head using a piezoelectric vibrator unit according to the present invention.
Figure 2:
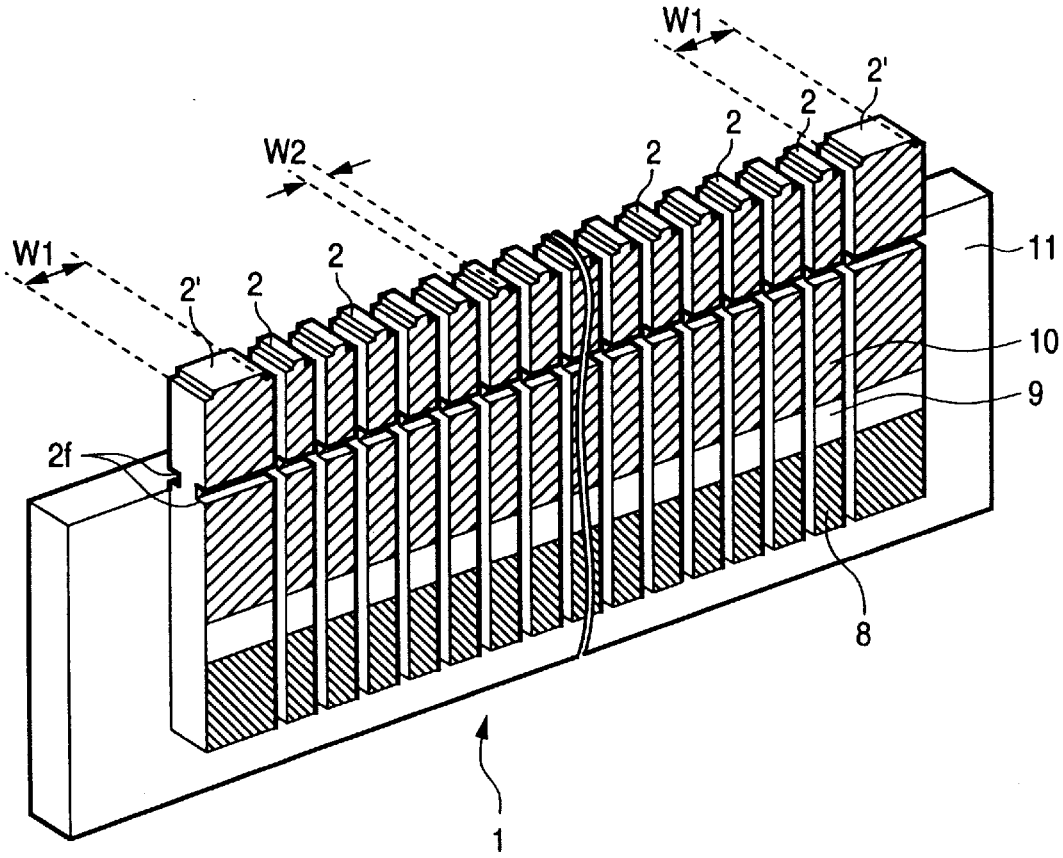
FIG. 2 is a perspective view showing the above piezoelectric vibrator unit.

FIG. 1 shows an embodiment of an ink-jet recording head using a piezoelectric vibrator unit according to the present invention, a reference numeral 1 denotes a piezoelectric vibrator unit characterized by the present invention and in the piezoelectric vibrator unit, an active area where common internal electrodes 3 functioning as one pole and individual internal electrodes 4 functioning as the other pole one end portions of which are respectively exposed only on one of a front face and a back face of the unit and wrapped in a central area are alternatively laminated in piezoelectric material 5, that is, a vibrational area, and an inactive area at the other end which is filled with only the piezoelectric material 5 and is not related to vibration, that is, a non-vibrational area are integrated.

In this embodiment, grooves 2*a* extended in a direction in which piezoelectric vibrators 2 are arrayed are formed in a boundary between the active area and the inactive area so as to reduce the constraint of the active area by the inactive area possibly.

A conductive layer 8 is formed on the back face 2*b* so as to include an internal electrode forming area on which the common internal electrode 3 of the piezoelectric vibrator 2 is exposed and extending up to the way of the front face 2*d* via the bottom face 2*c* of the piezoelectric vibrator 2, and a conductive layer 10 is formed on the front face 2*d* so as to include an internal electrode forming area on which the individual internal electrode 4 of the piezoelectric vibrator 2 is exposed and extending up to a position to the extent that fixed clearance 9 can be formed between the conductive layer 10 and the above conductive layer 8 on the front face 2*d*.

The piezoelectric vibrator 2 is fixed to a fixing substrate 11 by applying an adhesive to the side of the conductive layer 8. As the area of the surface is not limited by the cross section of the piezoelectric vibrator 2 inherently, size in which sufficient strength to fix the piezoelectric vibrator 2 can be secured can be selected.

In addition, as two conductive layers 8 and 10 with different poles are exposed on one side face of the piezoelectric vibrator 2 and located closely, the conductive pattern of a flexible cable 12 also functioning as a circuit board can be fixed on front faces of a group of the piezoelectric vibrators by soldering and others.

Each dummy piezoelectric vibrator 2' not related to an ink droplet is arranged at an end in a direction in which the piezoelectric vibrators 2 are arrayed. The dummy vibrator 2' is formed so that the width W1 thereof is twice or three times as wide as the width W2 of the piezoelectric vibrator 2 for driving. Hereby, the dummy piezoelectric vibrator 2' has high mechanical strength, and the positioning precision of the piezoelectric vibrator unit and the reliability of work for connection to the flexible cable 12 and the connection can be enhanced.

Figure 3:
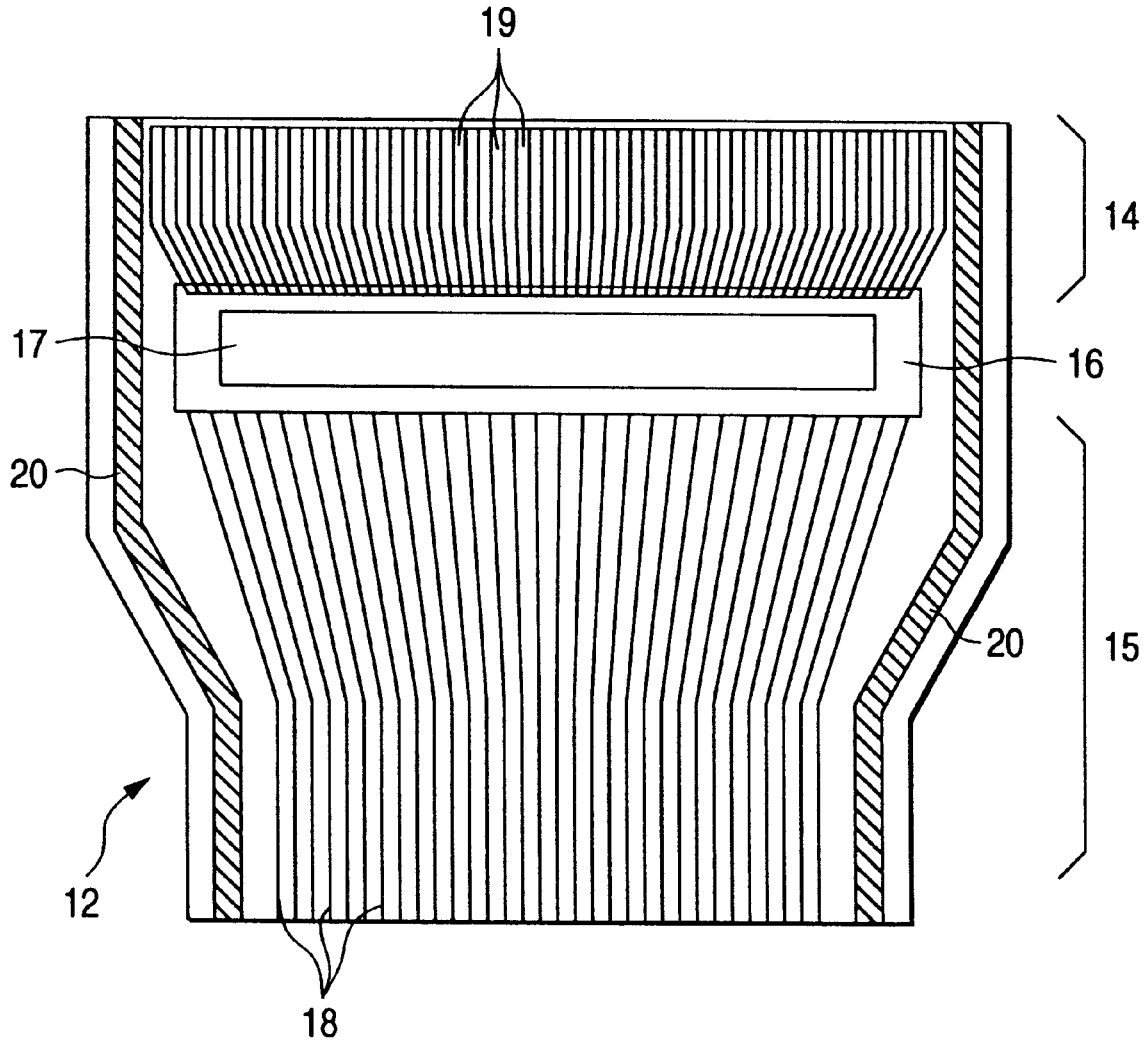
FIG. 3 shows an embodiment of a flexible cable.

On the other hand, the flexible cable 12 for supplying a driving signal from an external driving circuit to the piezoelectric vibrator unit 1 is divided into an area 14 for transmitting a driving signal to each piezoelectric vibrator 2 and an area 15 for transmitting a printing signal from the external driving circuit respectively shown in FIG. 3, a window 16 is formed in a boundary between these areas and a semiconductor integrated circuit 17 for converting a printing signal to a driving signal for driving each piezoelectric vibrator 2 is mounted in the window. A printing signal is supplied to the semiconductor integrated circuit 17 from the external driving circuit via conductive patterns 18 of the number smaller than the number of the piezoelectric vibrators 2 forming the unit. On the side of the end of the semiconductor integrated circuit 17, conductive patterns 19 of the same number as the number of the piezoelectric vibrators 2 are formed and on both sides of these, each conductive pattern 20 connected to the dummy piezoelectric vibrator 2' is formed.

Each individual internal electrode 4 of the piezoelectric vibrators 2 is connected to the conductive pattern 19 and each common internal electrode 3 is connected to the conductive pattern 20 via the conductive layer 8 by soldering each end of the conductive patterns 19 and 20 of the flexible cable 12 constituted as described above in a predetermined position of the conductive layers 10 and 8 of the piezoelectric vibrator 2 and the dummy piezoelectric vibrator 2', respectively.

To constitute an ink-jet recording head, the piezoelectric vibrator unit 1 is fixed to a head holder 25 on which a passage unit 24 including a pressure generating chamber 21, an ink supply port 22 and a reservoir 23 via the fixing substrate 11 while contacting the end of the piezoelectric vibrator 2 to an elastic plate 26 forming the pressure generating chamber 21. A reference numeral 27 denotes a nozzle aperture and a reference numeral 25*a* denotes an ink guide passage for supplying ink to the reservoir 23 from the outside.

To manufacture the above piezoelectric vibrator unit 1, there is prepared piezoelectric diaphragms 28 in which the common internal electrodes 3 and the individual internal electrodes 4 are laminated in the piezoelectric material 5 so that the respective electrodes are wrapped in a central area thereof and one end portions of the respective electrodes are exposed on only one of a front face and a back face thereof. Then grooves 28*a* extending in a longitudinal direction of the diaphragm is formed in the vicinity of that portion the active area and the inactive area are to be formed as shown in FIG. 4(*a*).

Figure 4A:
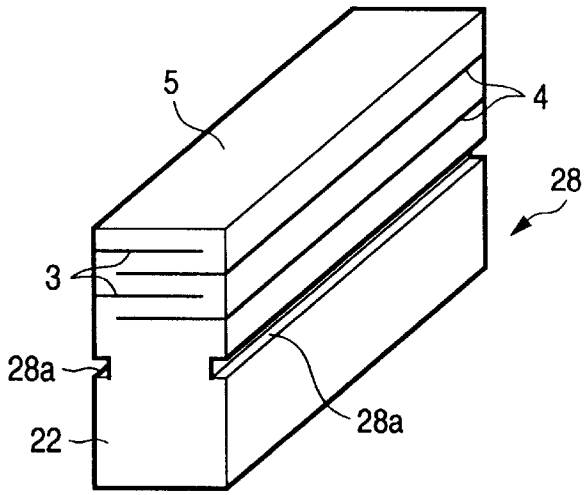
FIGS. 4(*a*) to (*c*) respectively show an embodiment of a method of manufacturing the piezoelectric vibrator unit according to the present invention.
Figure 4B:
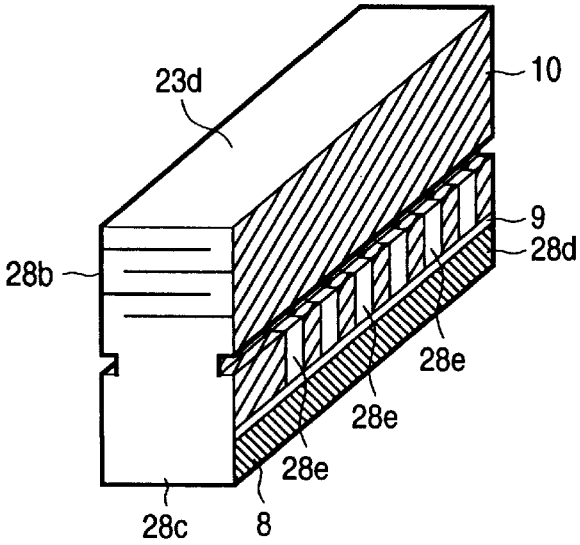
Figure 4C:
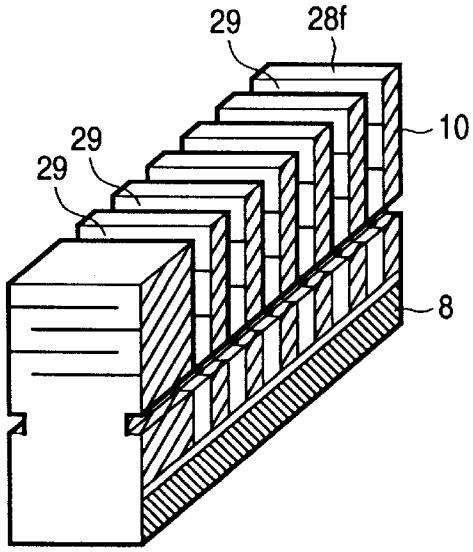

Next, a conductive layer 8 is formed on the back face 28*b* so as to include an internal electrode forming area on which the common internal electrode 3 is exposed and so as to extend up to the way of the front face 28*d* via the bottom face 38*c*, and a conductive layer 10 is formed on the front face 28*d* so as to include an internal electrode forming area on which the individual internal electrode 4 is exposed and so as to extend up to a position to the extent that fixed clearance 9 can be formed between the conductive layer 10 and the above conductive layer 8 on the front face 28*d* as shown in FIG. 4(*b*). In this embodiment, in the inactive area of the conductive layer 10, a non-conductive layer forming part 28*e* is alternately provided to prevent dielectric failure which is apt to occur in case depth in cutting is shallow.

After such preparation is finished, grooves 29 are formed up to the clearance 9 in the form of the teeth of a comb by a dicing cutter or a wire saw so that the groove has width required as the piezoelectric vibrator 2 is shown in FIG. 4(*c*) and finally, when the inactive area is fixed on the fixing substrate 11 by an adhesive, the above piezoelectric vibrator unit is obtained.

Figure 5:
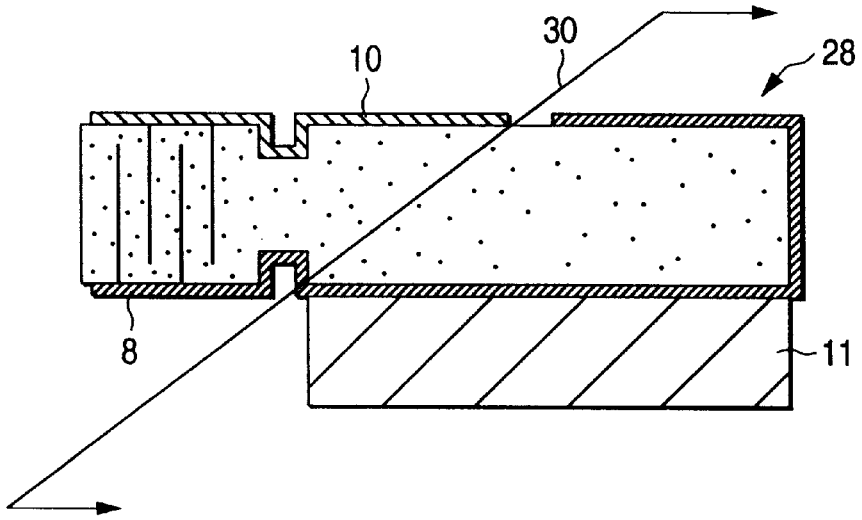
FIGS. 5(*a*) and 5(*b*) respectively show an embodiment of a process for cutting a piezoelectric diaphragm.
Figure 5:
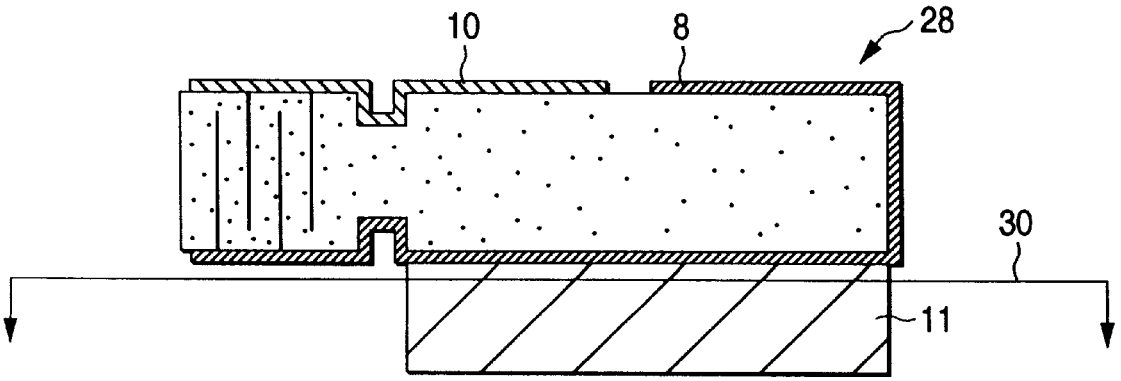

According to the above manufacturing method, the groove is cut from the top face 28*f* of the piezoelectric plate 28 to a boundary between the two conductive layers 8 and 10 so that the cutting face is in parallel with the top face 28*f*. Alternatively, as shown in FIG. 5(*a*), the piezoelectric plate 28 fixed on the fixing substrate 11 by an adhesive beforehand may be cut by a wire saw 30 diagonally so that the groove reaches at least for the inactive area with regard to the front face on which only the conductive layer 8 is formed and so that the groove reaches for that area two conductive layers 8 and 10 are opposed or that portion the conductive area 8 is formed with regard to the front face on which the two conductive layers 8 and 10 are formed. Still alternatively, as shown in FIG. 5(*b*), the piezoelectric plate 28 fixed on the fixing substrate 11 by an adhesive beforehand may be cut by the wire saw 30 from the front face on which the two conductive layers 8 and 10 are formed up to that extent the groove reaches for the fixing substrate 11 so that the cutting face is in parallel with the conductive layer.

Figure 6:
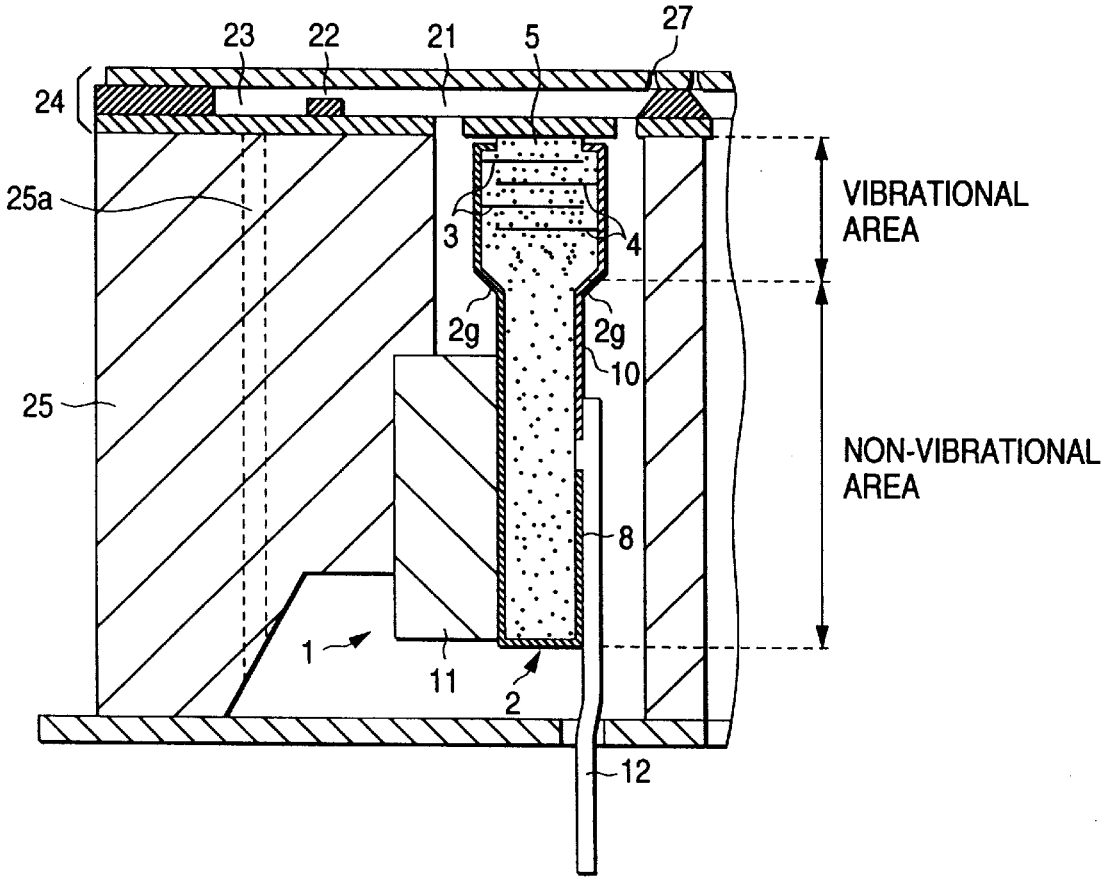
FIG. 6 is a sectional view showing another embodiment of an ink-jet recording head using the piezoelectric vibrator unit according to the present invention.
Figure 7A:
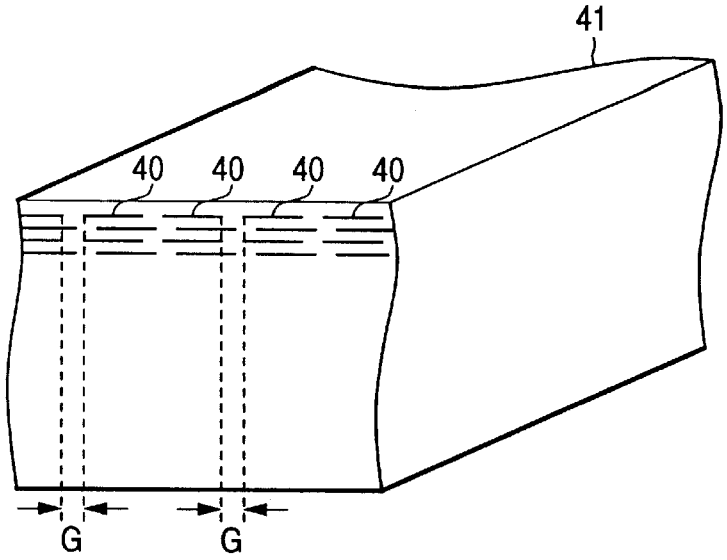
FIGS. 7(*a*) to (*c*) respectively show an embodiment of a method of manufacturing a piezoelectric diaphragm suitable when the above piezoelectric vibrator unit is manufactured.
Figure 7B:
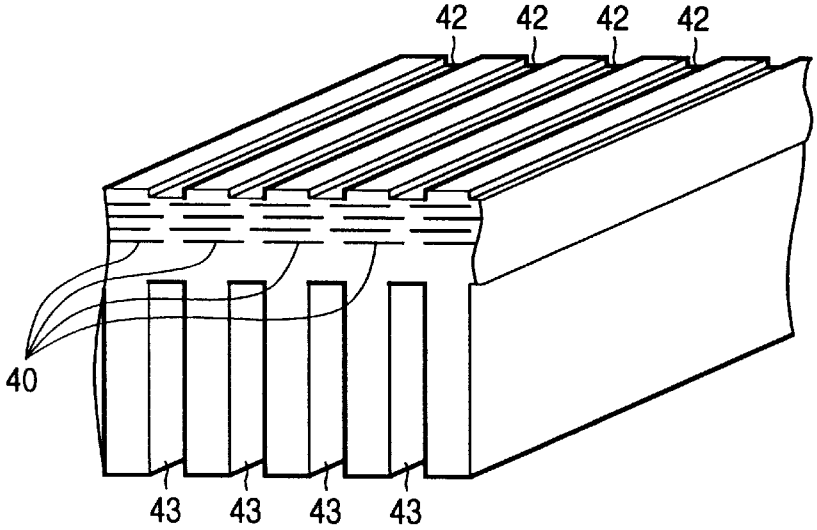
Figure 7C:
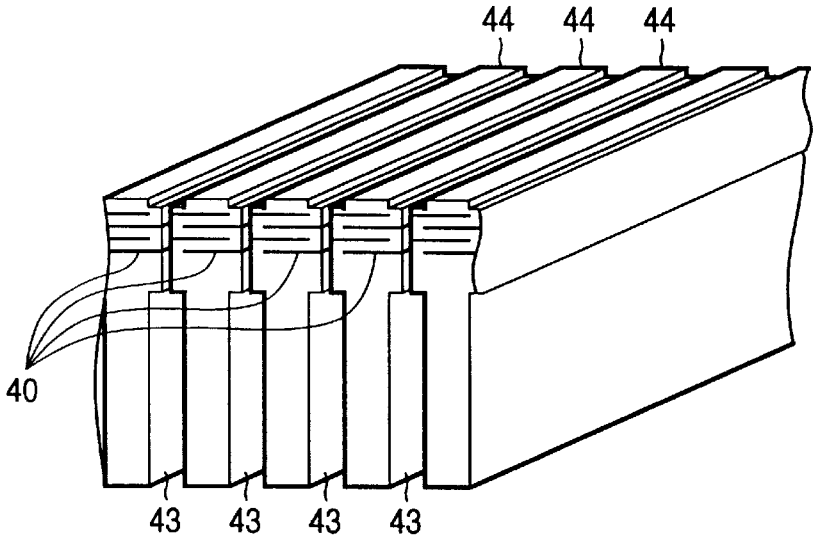

FIG. 6 shows another embodiment of the present invention and each piezoelectric vibrator 2 of a piezoelectric vibrator unit 1 is configured so that the cross section of an inactive area is smaller than that of an active area. Such a piezoelectric vibrator unit is easily manufactured as follows. There is prepared a cubic block 41 in which plural conductive layers 40 to be a common internal electrode 3 and an individual internal electrode 4 are formed in parallel at a fixed interval G as shown in FIG. 7(*a*). Then wide grooves 42 and 43 are formed by a relatively wide dicing cutter or wire saw as shown in FIG. 7(*b*). Next, an area in which the conductive layers 40 are provided is cut by a relatively narrow dicing cutter or wire saw with cut width to the extent that the cut part reaches the end of the conductive layer 40 and thereby a piezoelectric plates 44 are obtained as shown in FIG. 7(*c*).

Figure 8:
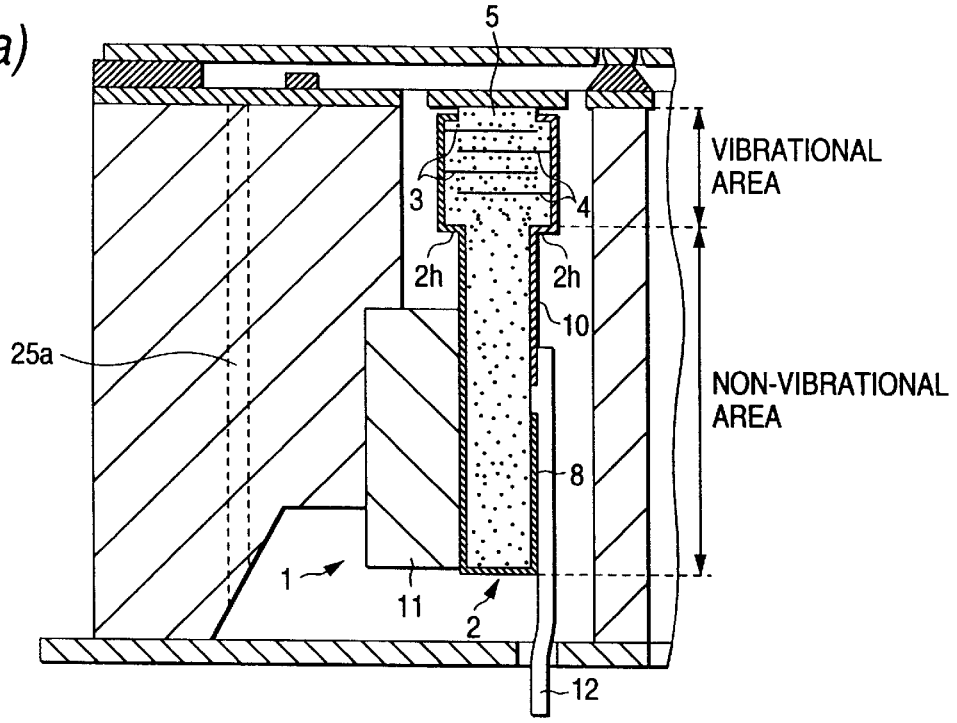
FIGS. 8(*a*) and 8(*b*) are sectional views respectively showing another embodiment of the present invention.
Figure 8:
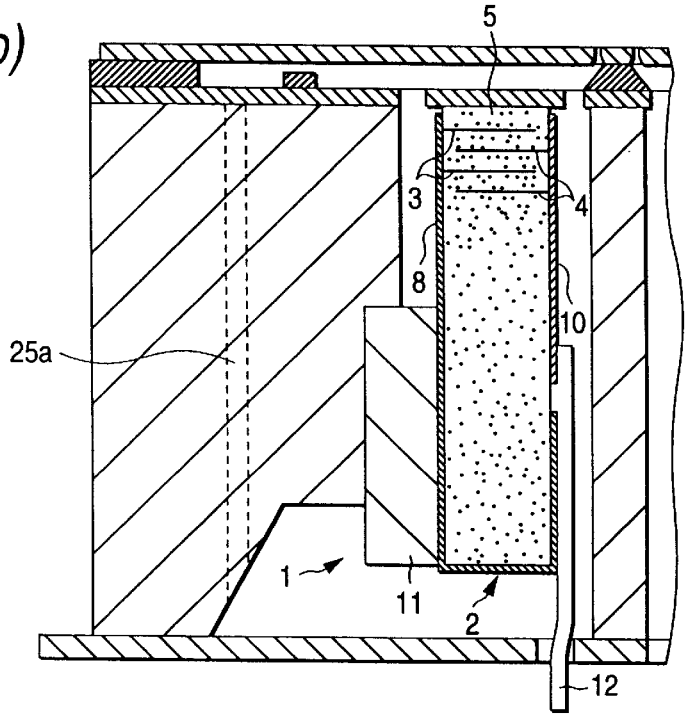

As shown in FIG. 8(*b*), as conductive layers 8 and 10 can be flat if a piezoelectric vibrator unit is formed so that it from one end to the other end has the same cross section, the conductive layers 8 and 10 can be more securely formed by a film forming method such as sputtering and deposition.

Figure 9:
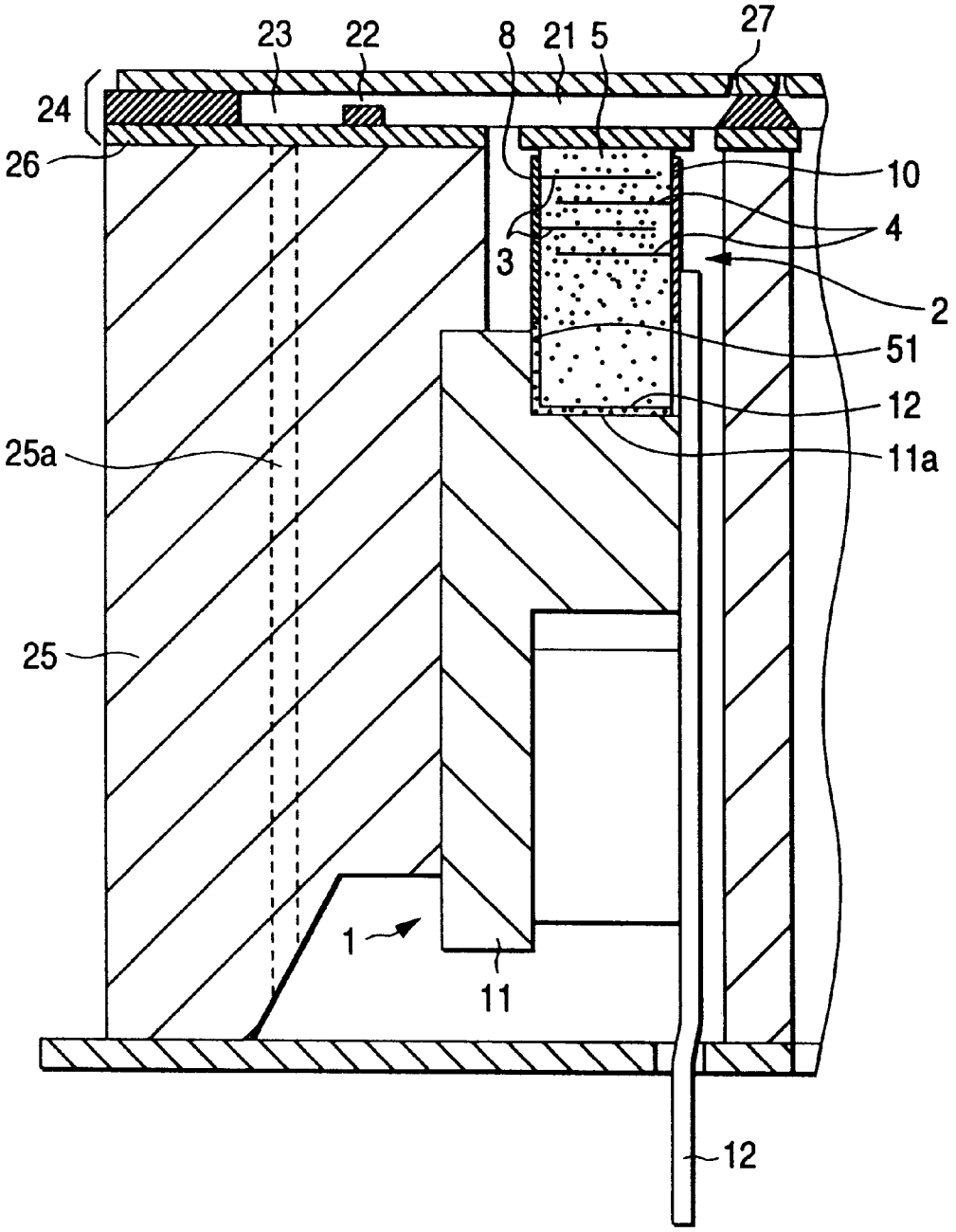
FIG. 9 shows an embodiment of an ink-jet recording head according to the present invention as sectional structure in a position of a piezoelectric vibrator for driving.

FIG. 9 shows another embodiment of the recording head using the piezoelectric vibrator unit according to the present invention. In a piezoelectric vibrator 2 for contracting or expanding a pressure generating chamber 21, common internal electrodes 3 and individual internal electrodes 4 are provided with a piezoelectric material 5 such that the respective electrodes are laminated so as to be wrapped in a central area of the vibrator and one end portions of the respective electrodes are exposed on only one of a front face and a back face of the vibrator to have a piezoelectric constant d33 to constitute an active area at one end portion of the vibrator. In the other end portion of the vibrator, only the piezoelectric material is provided to constitute an inactive area which is not related to the vibration.

Figure 10:
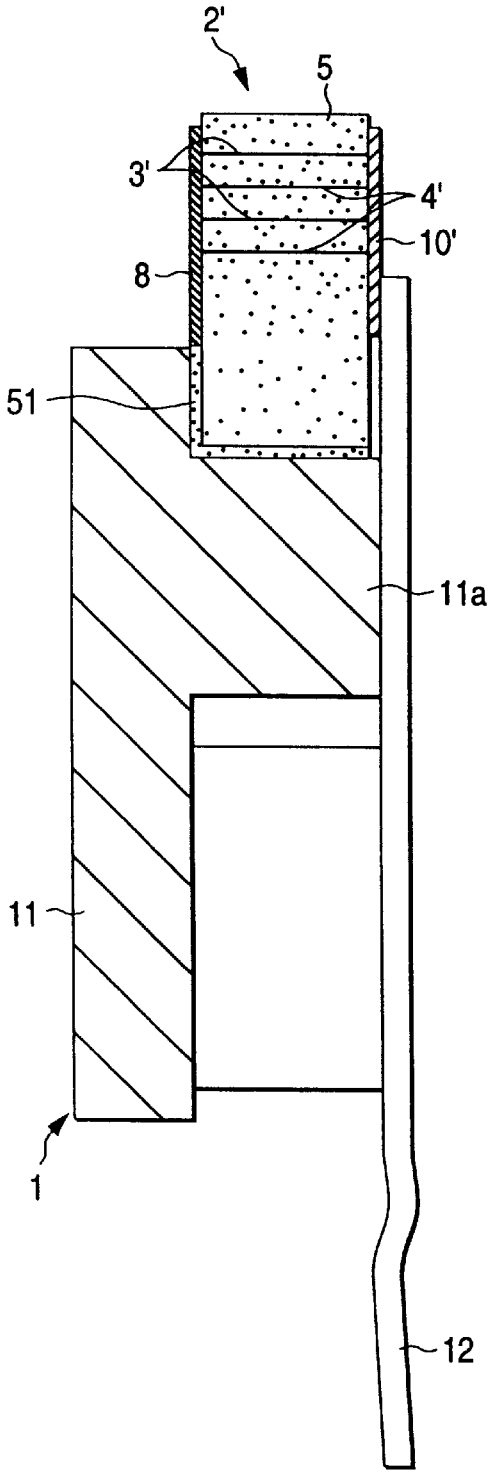
FIG. 10 shows the sectional structure of a dummy piezoelectric vibrator of the above ink-jet recording head.

A dummy piezoelectric vibrator 2' arranged at least at one end in a direction in which the piezoelectric vibrators 2 are arrayed and not related to jetting an ink droplet is produced in the similar process to the common internal electrode 3 and the individual internal electrode 4 of the above piezoelectric vibrator 2, however, the common internal electrode and the individual internal electrode are formed as internal electrodes for connection 3' and 4' in the piezoelectric material 5 so that both ends are exposed on both side faces as shown in FIG. 10.

A conductive layer 8 to be a common external electrode for connection extended from the top end of the piezoelectric vibrator 2 to the inactive area by the deposition of metal on each surface of the piezoelectric material 5 and others and a conductive layer 10 to be an individual external electrode are formed on the piezoelectric vibrator 2 and the dummy piezoelectric vibrator 2'.

Figure 11:
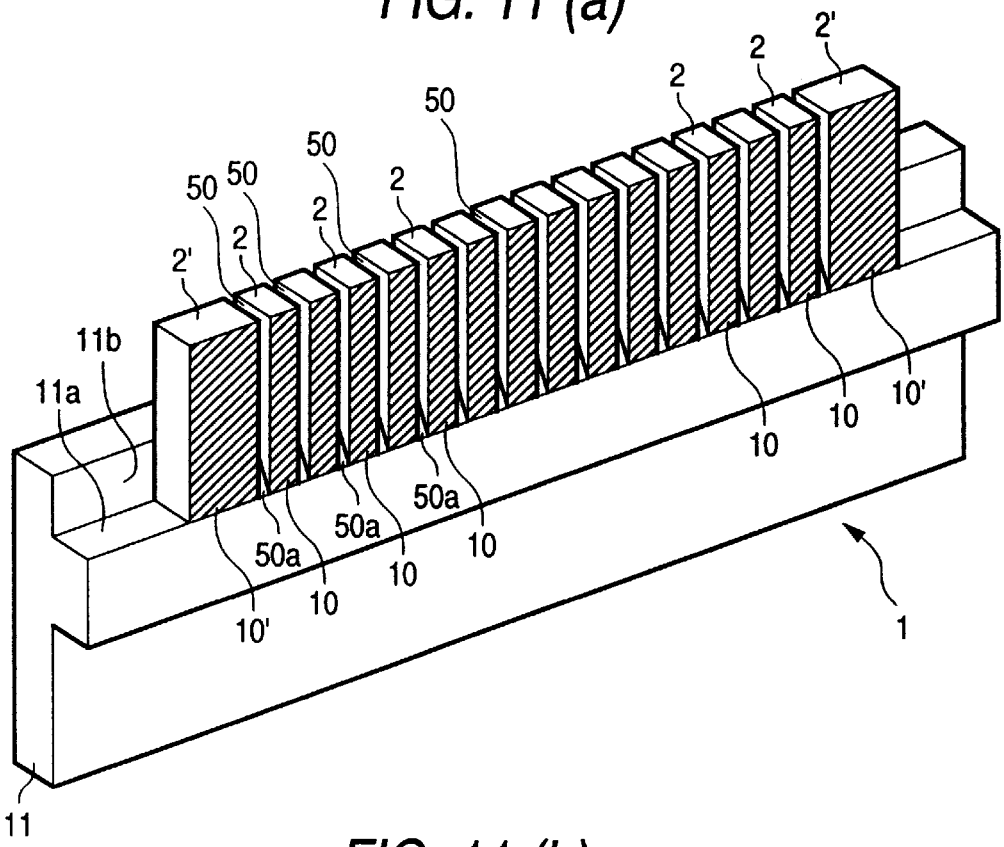
FIGS. 11(*a*) and 11(*b*) are perspective views respectively showing the structure on the top side and the back side of an embodiment of the above piezoelectric vibrator unit.
Figure 11:
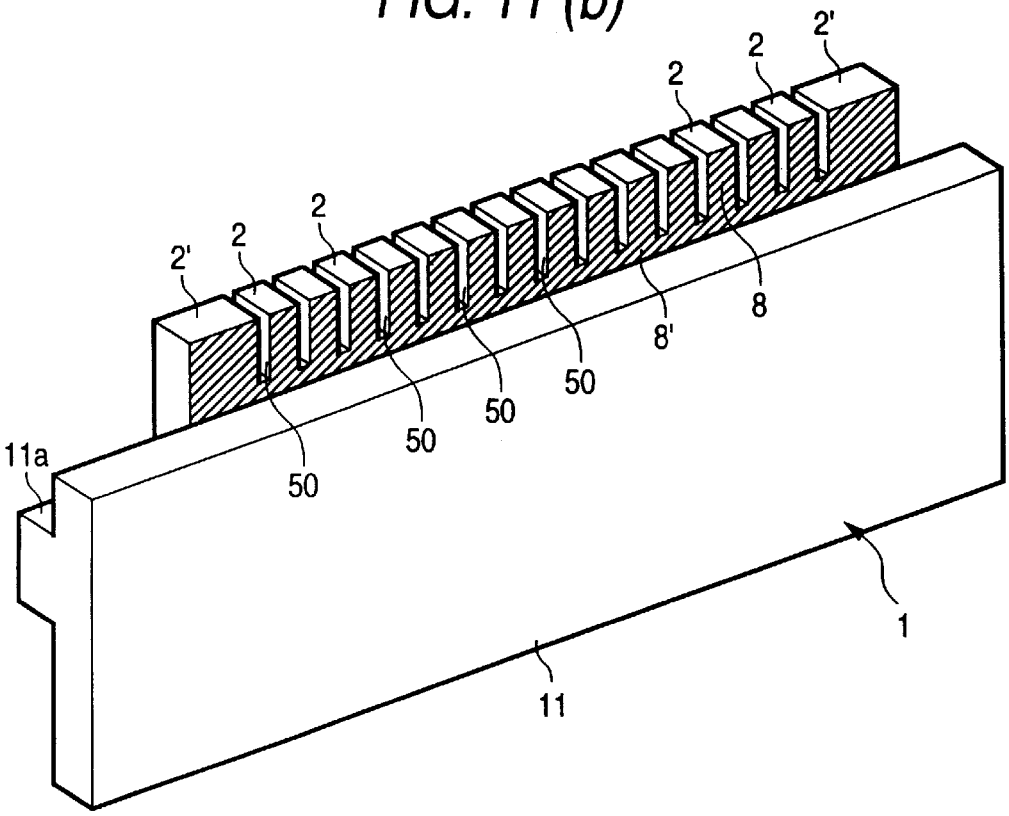
Figure 12A:
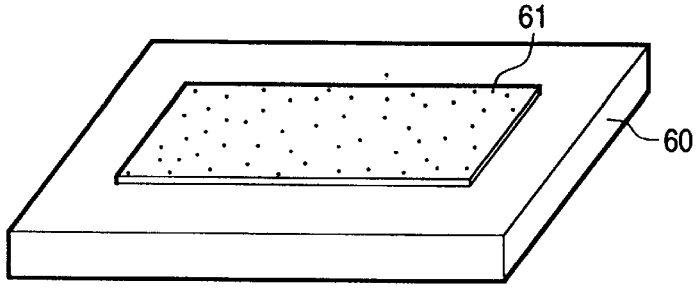
FIGS. 12(*a*) to (*d*) respectively show a process for manufacturing a piezoelectric material plate used for the piezoelectric vibrator unit according to the present invention.
Figure 12B:
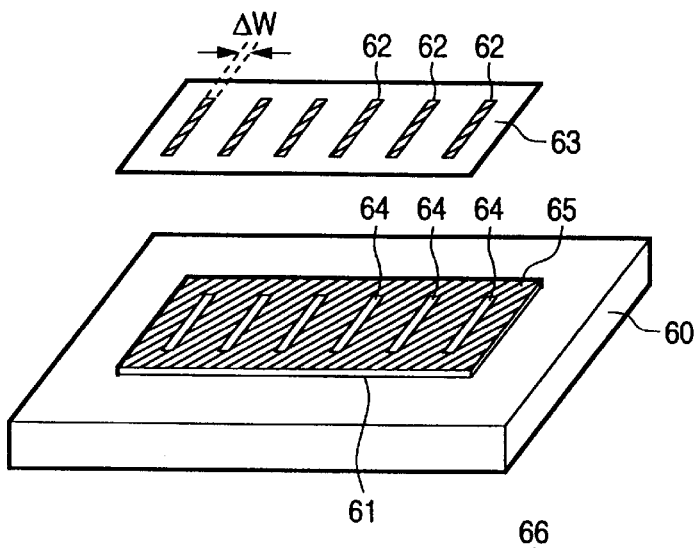
Figure 12C:
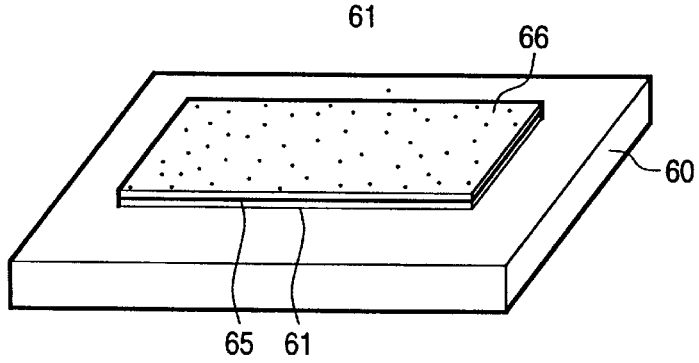
Figure 12D:
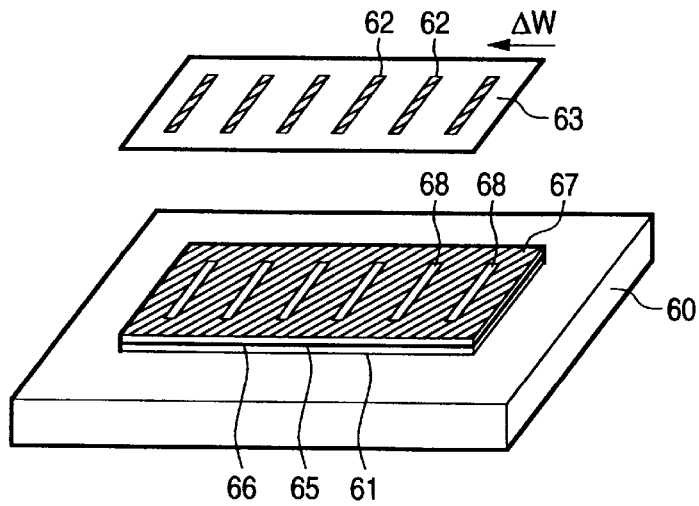

As shown in FIG. 11(*a*), the vibrational areas of the conductive layers 8 and 10 are separated by grooves 50 provided with the bottom 50*a* slanted to leave a non-vibrational area. Hereby, the conductive layer 10 is completely separated between the piezoelectric vibrators 2 and the dummy piezoelectric vibrator 2' and the conductive layer 8 is provided with a continuous part 8' as shown in FIG. 11(*b*).

To constitute the piezoelectric vibrator unit 1, each bottom portion of the piezoelectric vibrator 2 and dummy piezoelectric vibrator 2' are secured to a step 11*a* formed on a fixing substrate 11 and side face of the inactive area is secured to the surface of the fixing substrate 11 via an adhesive layer 51.

Owing to the internal electrodes 3' and 4' of the dummy piezoelectric vibrator 2' and the groove 50 the bottom 50*a* of which is slant, the conductive layers 8 of all the piezoelectric vibrators 2 and 2' are not separated and thereby a parallel connection of all the piezoelectric vibrators 2 and 2' can be realized by the continuous part 8' formed in the vicinity of the upper part of the fixing substrate 11. The common internal electrodes 3' and 4' formed so that both surfaces of the dummy piezoelectric vibrator 2' are pierced connect the conductive layer 8 to be the common connecting external electrode of each piezoelectric vibrator 2 with the conductive layer 10' exposed on the side of a front face of the fixing substrate 11 of the dummy piezoelectric vibrator 2' to electrically connecting with each other.

The flexible cable 12 shown in FIG. 3 is fixed to the piezoelectric vibrator unit constituted as described above by soldering the end of the conductive pattern 19 to the conductive layer 10 of the piezoelectric vibrator 2 and soldering the conductive pattern 20 on both sides to the conductive layer 10' of the dummy piezoelectric vibrator 2'.

In this embodiment, the exposed surface of the semiconductor integrated circuit 17 mounted on the flexible cable 12 is fixed on the front face of the fixing substrate 11 so that heat due to loss in operation is radiated via the fixing substrate 11.

In this embodiment, when an printing signal is input to the semiconductor integrated circuit 17 via the flexible cable 12 from an external driving circuit, the semiconductor integrated circuit 17 generates a driving signal and the driving signal is supplied to the conductive layer 8 of the piezoelectric vibrator 2 via the conductive pattern 19 and the conductive layer 8 on the back face of the dummy piezoelectric vibrator 2' via the internal electrodes 3' and 4' thereof.

Hereby, only selected piezoelectric vibrators 2 are extended or contracted in an axial direction thereof by selectively applying a driving signal to the conductive layer 10 by a divided segment electrode on respective piezoelectric vibrator, a specific pressure generating chamber 21 in a passage unit 24 is contracted or expanded and an ink droplet is jetted.

Next, a method of manufacturing the above piezoelectric vibrator unit 1 will be described.

A green sheet 61 of piezioelectric material with predetermined thickness is loaded on a surface substrate 60 as shown in FIG. 12(*a*). When conductive material is formed on the surface of the green sheet 61 using a screen 63 provided with masks 62 in an internal electrode unformed area on both sides, a conductive layer 65 to be the common internal electrode 3 or the individual internal electrode 4 is formed with green sheet exposed areas 64 at an interval at which internal electrodes are not wrapped are left as shown in FIG. 12(*b*).

After a second green sheet 66 is overlapped on the surface of the conductive layer 65 as shown in FIG. 12(*c*), the screen 63 is shifted by the width ΔW of the mask 62 in a direction in which the masks 62 are arrayed and a conductive layer 67 is formed as described above as shown in FIG. 12(*d*).

Hereby, green sheet exposed areas 68 are formed in an area in which the piezoelectric vibrator 2 is to be formed so that a part of the conductive layers 65 and 67 is not wrapped and the conductive layers 65 and 67 are formed in an area in which the dummy piezoelectric vibrator 2' is to be formed (an upper area and a lower area in FIG. 12) so that the conductive layers 65 and 67 are wrapped in any area.

A process that a layer of conductive material is formed with the screen 63 located again in a position shown in FIG. 12(*b*) after a green sheet 55 of piezoelectric material is overlapped is repeated by the number of layers to be laminated. Then it is baked after drying at temperature suitable for baking ceramics, for example at 1200° C., a piezoelectric material is formed finally or initially as shown in FIG. 13(*a*).

Figure 13A:
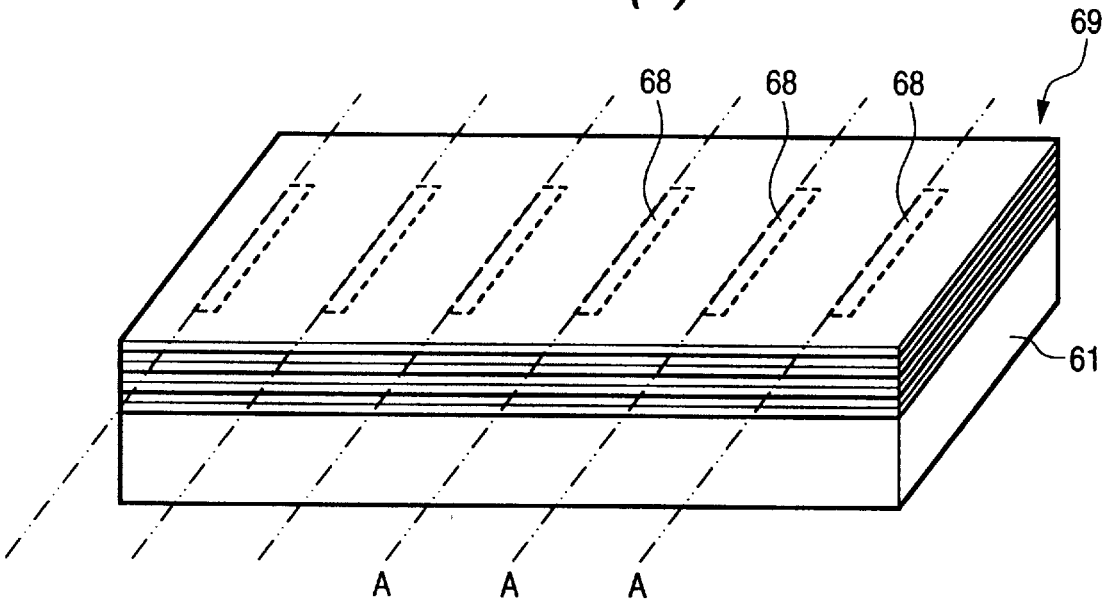
FIGS. 13(*a*) and 13(*b*) respectively show a process for manufacturing a piezoelectric vibrator based upon the piezoelectric material plate.
Figure 13B:
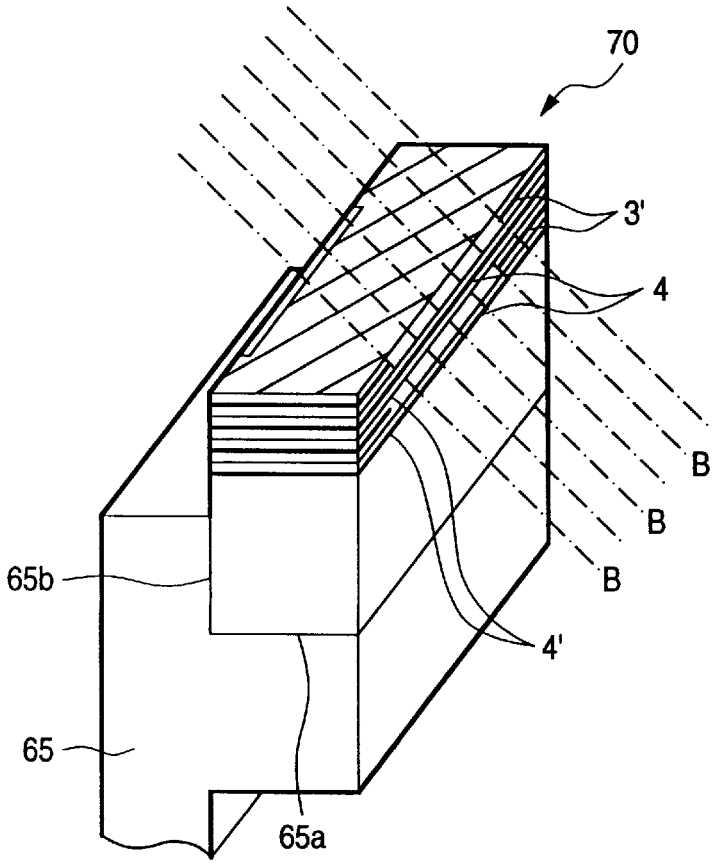
Figure 14:
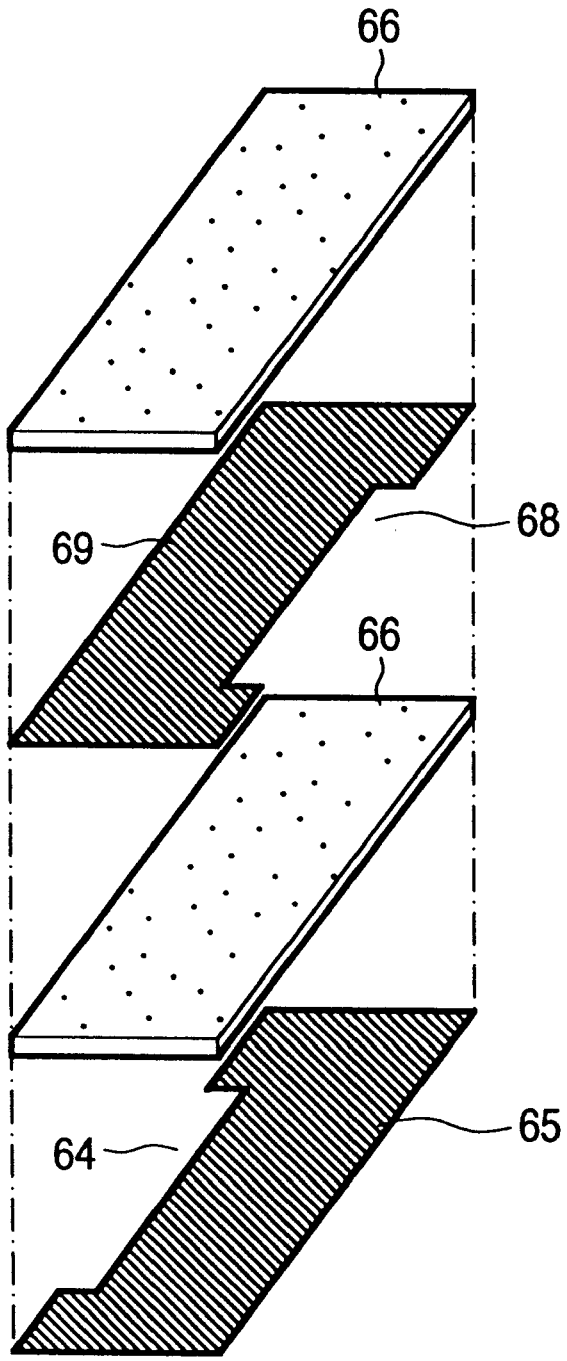
FIG. 14 schematically shows an internal electrode formed on the piezoelectric material plate.
Figure 15:
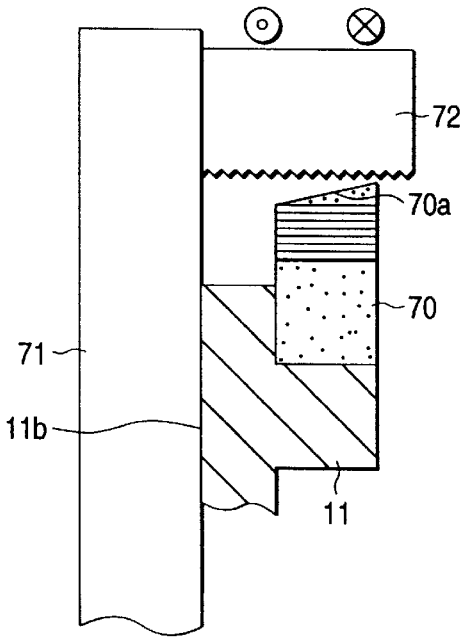
FIGS. 15(*a*) and 15(*b*) respectively show an embodiment of a method of forming the end face of a piezoelectric diaphragm.
Figure 15:
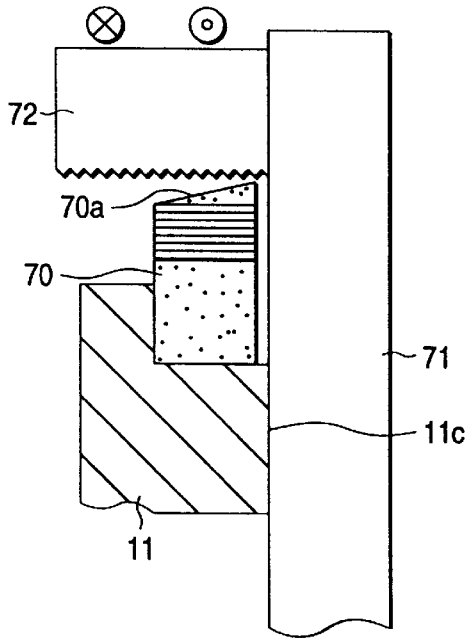

When the piezoelectric material plate 69 is cut in the form of a strip by a wire saw and others using each one boundary of the internal electrode unformed parts 64 and 68 as a cutting plane line B as shown in FIG. 13(*b*),a small piezoelectric material plate 70 wherein notches 64 and 68 are formed on one side in a central area as shown in FIG. 14 and electrode layers 65 and 69 extended to both sides are formed at both ends can be obtained.

After a conductive layer is formed on both sides of the piezoelectric material plate 70 by sputtering and others, a bottom portion and the inactive layer thereof are fixed to a fixing substrate 11 by an adhesive.

When forming processing is finished, a groove is formed as shown in FIG. 13(*b*) by slanting a wire saw for a plane at the upper end of a block 70 as shown by the line B so that an area at both ends in which two internal electrodes 3' and 4' are both exposed is to be the dummy piezoelectric vibrator 2' and the center of an area in which only one of the common internal electrode 3 and the individual internal electrode 4 is exposed on one side is to be a width suitable for the piezoelectric vibrator 2.

When forming processing is finished, a groove is formed as shown in FIG. 13(II) by slanting a wire saw for a plane at the upper end of a block 70 as shown by the line B so that an area at both ends in which two internal electrodes 3' and 4' are both exposed is to be the dummy piezoelectric vibrator 2' and the center of an area in which only one of the common internal electrode 3 and the individual internal electrode 4 is exposed on one side is to be a width suitable for the piezoelectric vibrator 2.

Hereby, there can be obtained the piezoelectric vibrator unit 1 provided with the dummy piezoelectric vibrators 2' which function as a connection member to the common internal electrode at both ends and the piezoelectric vibrators 2 in fixed pitch in a central area.

In the above embodiment, forming processing is executed after a conductive layer is formed in a block 42, however, forming processing may be also executed before a conductive layer is formed.

Figure 16:
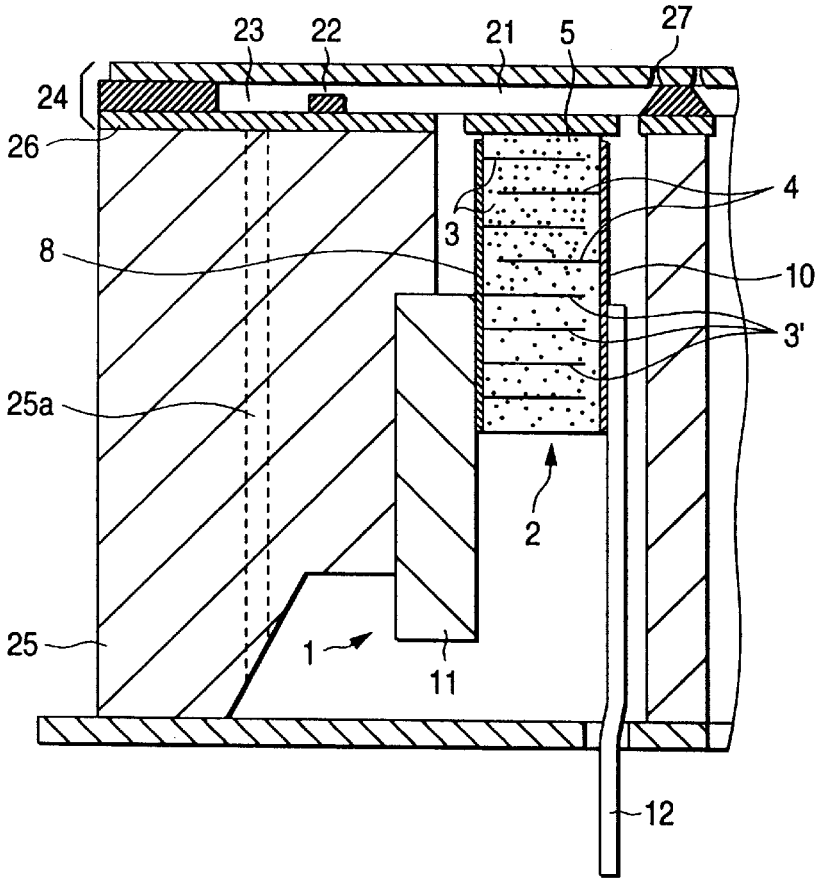
FIG. 16 is a sectional view showing another embodiment of the ink-jet recording head according to the present invention.
Figure 17:
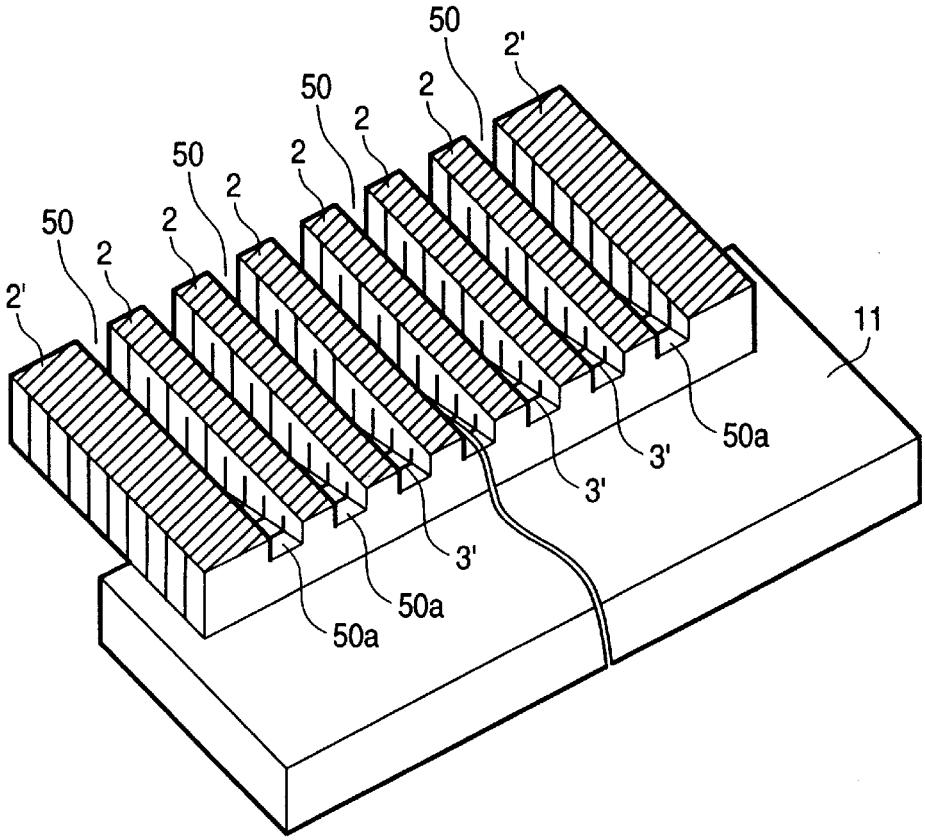
FIG. 17 is a perspective view showing a piezoelectric vibrator unit of the above recording head.

FIG. 16 shows another embodiment of the present invention and a piezoelectric vibrator unit 1 is constituted by forming grooves 52 each bottom 52*a* of which is slant in one vibrator plate in fixed pitch in the form of the teeth of a comb as shown in FIG. 17 and forming piezoelectric vibrators for driving 2 and dummy piezoelectric vibrators 2' not related to vibration.

Figure 18:
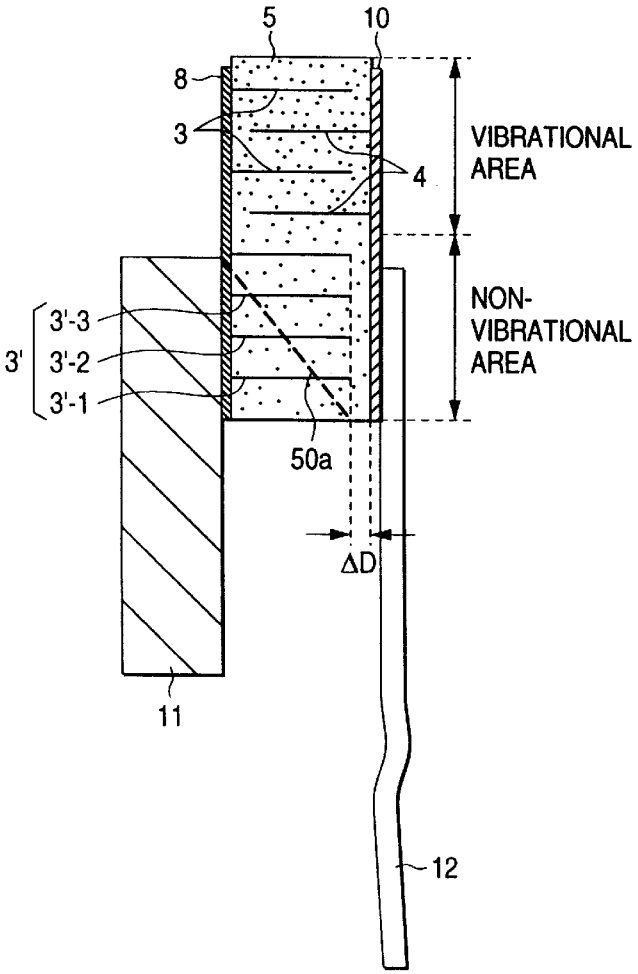
FIGS. 18(*a*) and 18(*b*) are sectional views showing the respective structure of a piezoelectric vibrator for driving and a dummy piezoelectric vibrator respectively composing the unit.
Figure 18:
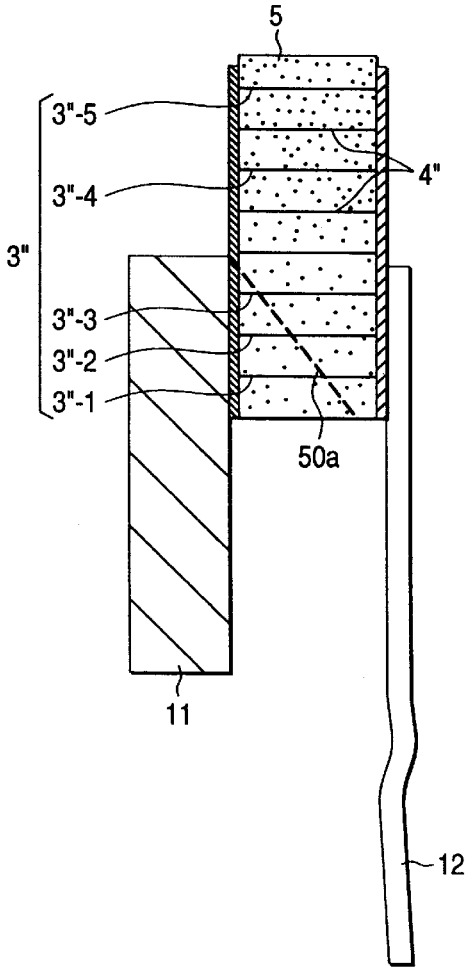

In this embodiment, the piezoelectric vibrator for driving 2 is constituted so that the side of the free end of a vibrator 24 functions as a vibrational area and an area fixed to a fixing substrate 11 functions as a non-vibrational area as shown in FIG. 18(*a*).

In the vibrational area, a common internal electrode 3 and an individual internal electrode 4 are laminated together with piezoelectric material 5 as described above so that one end portions of the common internal electrode and the individual internal electrode are respectively exposed at one side face of the vibrator. In the non-vibrational area, only common internal electrodes 3' are laminated together with the piezoelectric material 5.

In the meantime, the dummy piezoelectric vibrator 2' is constituted by laminating internal electrodes 3" and 4" at fixed pitch from a top end portion to a bottom portion of the vibrator together. Both end portions of the above common internal electrode 3 and individual internal electrode 4 are exposed on both side faces of the vibrator as shown in FIG. 18(*b*).

As in the above embodiments, a conductive layer 8 is formed on the surface on which the common internal electrode 3 and the internal electrode 3' are exposed and a conductive layer 10 is formed on the surface on which the individual internal electrode 4 is exposed.

According to such configuration, while the individual internal electrodes 4 of the piezoelectric vibrators 2 are connected to the conductive layer 10 in parallel, it is separated by a groove 50 provided with the bottom 50*a* composed of a slant as in the above embodiment and whereby a driving signal can be independently applied.

Figure 19:
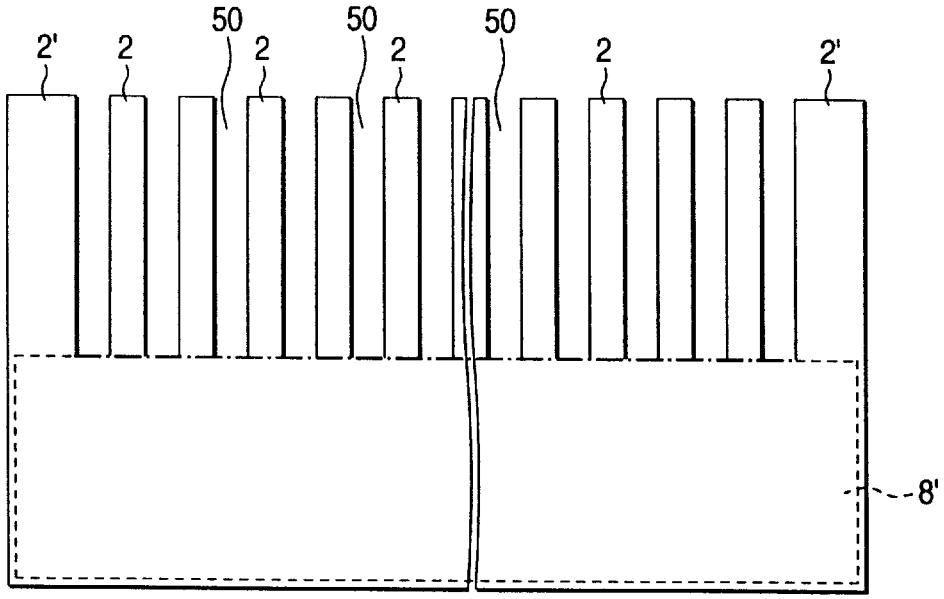
FIGS. 19(*a*) and 19(*b*) respectively shows relationship between a piezoelectric vibrator constituted by cutting and a conductive layer for connection to an external device formed on the piezoelectric vibrator and shows an embodiment of a junction area.
Figure 19:
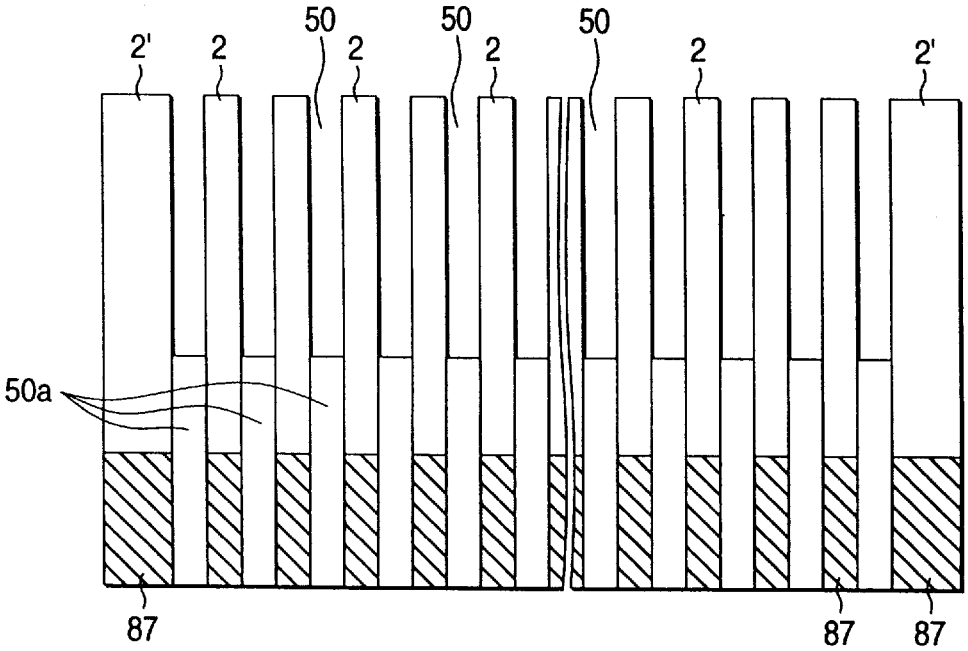

In the meantime, the common internal electrodes 3 in the vibrational area of the piezoelectric vibrator for driving 2 are connected in parallel via the conductive layer 8 and connected in parallel by a continuous part 8' which continues on the side of the fixing substrate as shown in FIG. 19(*a*). In addition, as internal electrodes 3'-1 and 3'-2 in the non-vibrational area are continuous in the area of the bottom 50*a* without being separated, they are connected in parallel hereby.

These internal electrodes 3'-1 and 3'-2 and the conductive layer 8 are connected to only the conductive layer 10 in the area of the dummy piezoelectric vibrators 2' via the internal electrodes 3" and 4" of the dummy piezoelectric vibrator 2'.

Hereby, a driving signal can be supplied to the piezoelectric vibrator for driving 2 by bonding and fixing the conductive pattern 19 of the flexible cable 12 shown in FIG. 3 to an area shown by hatching of the piezoelectric vibrator for driving 2 as shown in FIG. 19(*b*) and bonding and fixing the conductive pattern 20 to an area shown by hatching of the dummy piezoelectric vibrator 2' respectively using soldering, a conductive adhesive and others.

In such conductive joining, when heating and crimping are executed via an anisotropic conductive bonding sheet, conductivity emerges because of pressure in joining only in an area in which the piezoelectric vibrators 2 and the dummy piezoelectric vibrators 2' exist and as an area opposite to the grooves 50 is still in a state of high resistance because no pressure is applied, adjacent piezoelectric vibrators are not short-circuited and conductive joining is enabled without requiring work for applying soldering paste and work for forming a solder layer.

Next, a method of manufacturing the piezoelectric vibrator unit 1 constituted as described above will be described. A green sheet 80 of piezoelectric material with size for plural pieces, 12 pieces in this embodiment is loaded on a surface plate. A conductive layer is formed using a mask 81.

Figure 20:
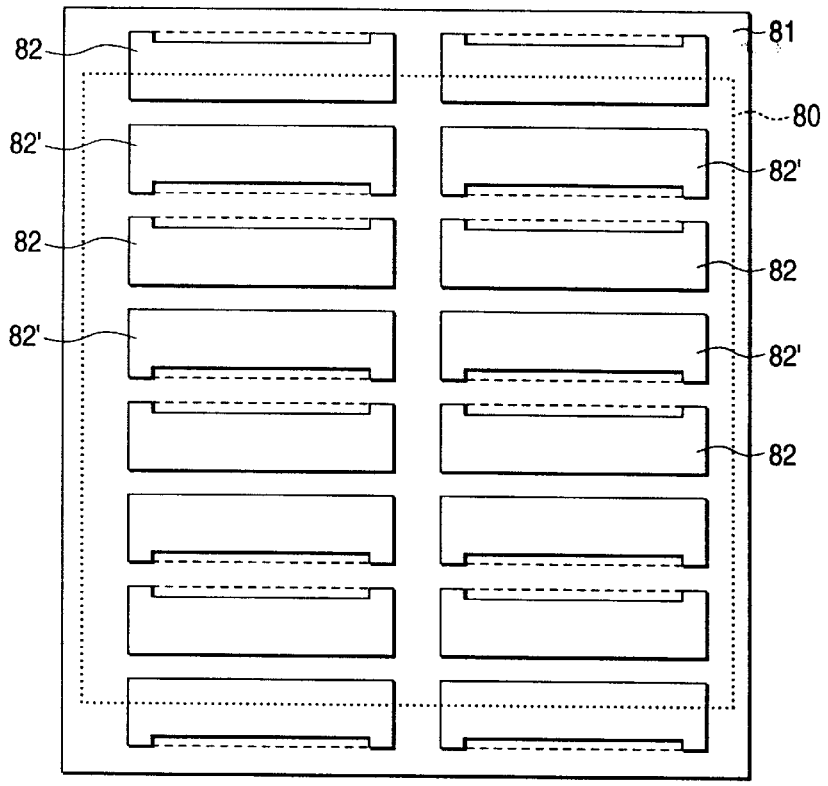
FIGS. 20(*a*) and 20(*b*) respectively shows an embodiment of a mask for forming an internal electrode of the above piezoelectric vibrator and is an enlarged view showing a window formed in the mask.
Figure 20:
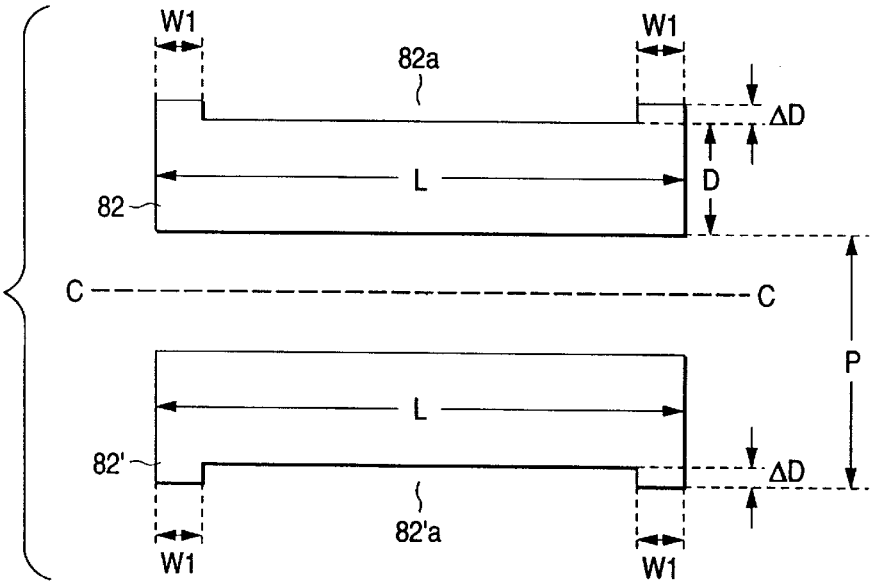

As shown in FIG. 20(*b*), a first window 82 and a second window 82' symmetrical based upon a line C—C in parallel with a longitudinal direction are formed at fixed pitch P in the above mask. Each window is provided with length L approximately equivalent to the length in a direction in which the piezoelectric vibrators are arrayed of the piezoelectric vibrator unit and width D equivalent to the width of the individual internal electrode and the common internal electrode in a central area, and protruded portions each having width equivalent to the thickness W1 of the dummy piezoelectric vibrator are formed on one side end of both end portions corresponding to an area in which the dummy piezoelectric vibrators are to be formed.

Figure 21:
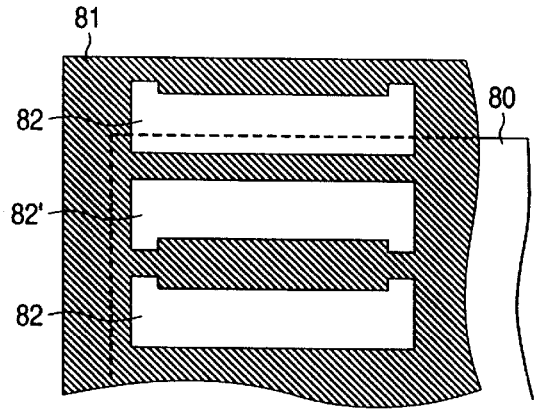
FIGS. 21(*a*) and 21(*b*) respectively show the position of the mask in a process for forming a first conductive layer by the mask and the conductive layer and FIGS. 21(*c*) and 21(*d*) respectively show the position of the mask in a process for forming a second conductive layer by the mask and the conductive layer.
Figure 21:
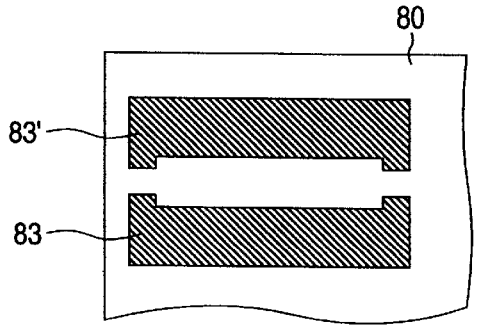
Figure 21:
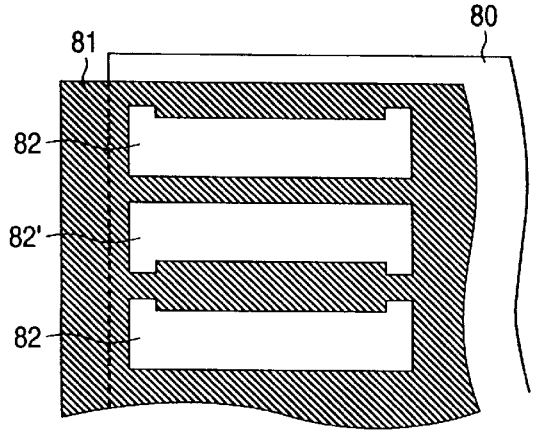
Figure 21:
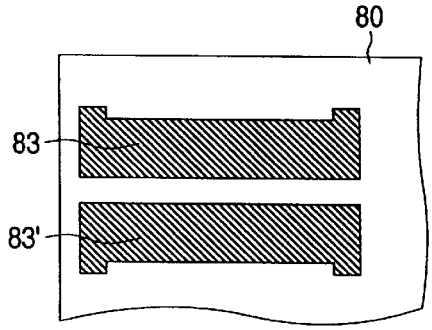

That is, the mask 81 is positioned in the predetermined position of the green sheet as shown in FIG. 21(*a*) and the conductive layer is formed. Hereby, as shown in FIG. 21(*b*), an internal electrode layer 83 is formed by the first window 82 and an internal electrode layer 83' is formed by the second window 82' in fixed pitch P.

The similar green sheet to the above green sheet 80 is loaded on the surface on which the internal electrode layers 83 and 83' are formed, the mask 81 is shifted by one pitch P and printing is executed. Hereby, as shown in FIG. 21(*d*), an internal electrode layer 83 is formed by the first window 82 and an internal electrode layer 83' is formed by the second window 82' with endpoints adjusted to the internal electrode layer 83' and the internal electrode layer 83 respectively formed in the prior process.

Such a process is repeated up to the length of the piezoelectric vibrator.

Hereby, in an area at both ends of the internal electrode layer 83 formed by the window 82 and the internal electrode layer 83' formed by the window 82', either side is protruded by ΔD from a central area and in the central area, conductive layers provided with an area in which one of them is not formed by ΔD are alternately formed vertically with piezoelectric material between them.

A lamination constituted as described above is dried and baked, cut with one end of conductive layers aligned and divided into small piezoelectric diaphragms.

After a conductive layer 8 to be an external electrode is formed on one side of the vibrator plate and a conductive layer 10 to be an external electrode is formed on the other side, one end is fixed on a fixing substrate composed of material at least the surface of which is provided with conductivity such as stainless steel by a conductive adhesive, the above groove 50 the bottom 50*a* of which is slant is formed by a wire saw and divided into piezoelectric vibrators for driving 2 and dummy piezoelectric vibrators 2' in the form of the teeth of a comb.

In the above embodiment, the common internal electrodes for connection 3' and 4' both ends of which are exposed on both side faces of the respective dummy vibrator 2' are provided from the top end portion to the bottom end portion of the respective dummy vibrator 2'.

Figure 22:
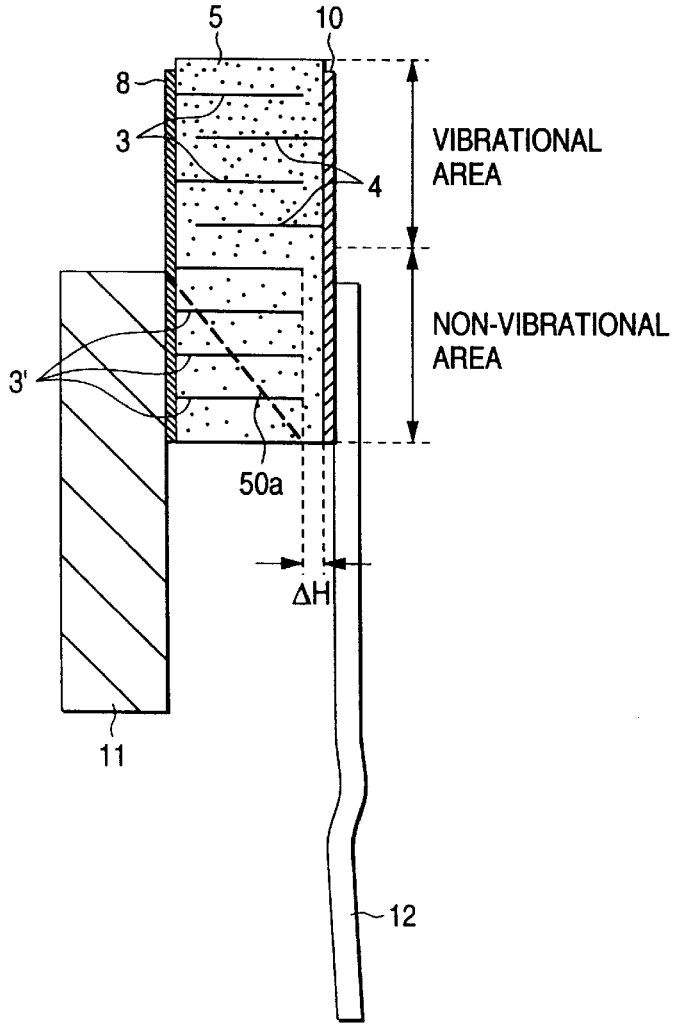
FIGS. 22(*a*) and 22(*b*) respectively show the respective sectional structure of a piezoelectric vibrator for driving and a dummy piezoelectric vibrator in another embodiment of the piezoelectric vibrator unit according to the present invention.
Figure 22:
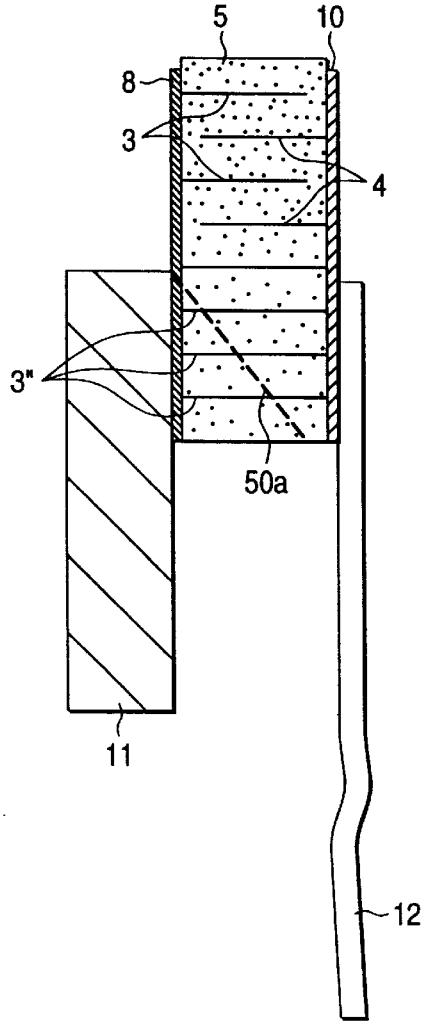

To produce the similar action, as shown in FIG. 22, it may be configured that internal electrodes 3 and 4 one end portions of which are respectively exposed only on the side face of the vibrator 2' in that area corresponding to the vibrational area of the vibrator for driving 2, and internal electrodes for connection 3" both ends of which are exposed on both side faces of the vibrator 2" are formed in an area corresponding to the non-vibrational area of the vibrator for driving 2.

Figure 23:
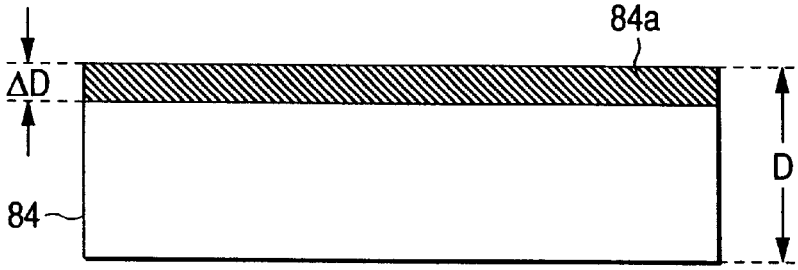
FIGS. 23(*a*) to (*c*) respectively show an embodiment of three types of masks for manufacturing the above piezoelectric vibrator unit in the form of a window.
Figure 23:
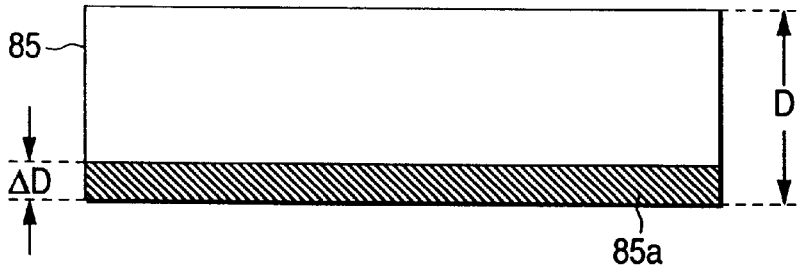
Figure 23:
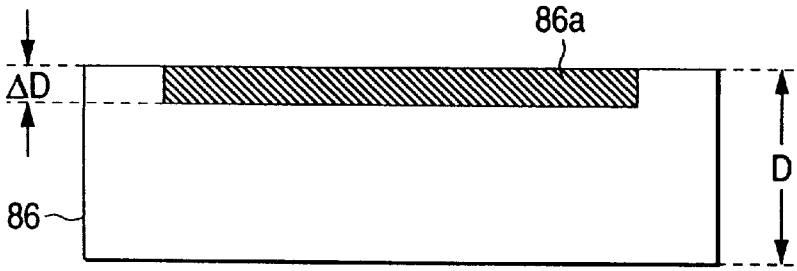

In this case, a first mask provided with a window 84 provided with a conductive layer unformed area 84*a* on one side and shown in FIG. 23(*a*) and a second mask provided with a window 85 provided with a conductive layer unformed area 85*a* on the other side and shown in FIG. 23(*b*) are used and the vibrational area including each piezoelectric material layer between conductive layers is formed by these masks.

In an area for a vibrator for driving to be formed, the non-vibrational area including piezoelectric material between conductive layers is formed using only one type of mask provided with a window 86 provided with a conductive layer unformed area 86*a* on one side is formed as shown in FIG. 23(*c*).

Hereby, an internal electrode exposed only on one side face is formed in the non-vibrational area of the piezoelectric vibrator for driving and an internal conductive layer both ends of which are exposed is formed in an area corresponding to the non-vibrational area of the dummy piezoelectric vibrator.

The above lamination is dried, baked, cut with each one end of conductive layers aligned and divided into small piezoelectric plates.

After a conductive layer 8 to be an external electrode is formed on one side of the vibrator plate and a conductive layer 10 to be an external electrode is formed on the other side, one end is fixed on a fixing substrate composed of material at least the surface of which is provided with conductivity such as stainless steel by a conductive adhesive, the above groove 50 the bottom 50*a* of which is slant is formed by a wire saw and divided into piezoelectric vibrators for driving 2 and dummy piezoelectric vibrators 2' in the form of the teeth of a comb.

According to this embodiment, as two types of masks have only to be set in the respective predetermined positions in the vibrational area, the above operation for shifting by pitch P is not required, a movement mechanism provided with fine positioning precision is not required and as the same mask has only to be set in the same position in a non-vibrational area, labor for replacing masks can be omitted.

Hereby, manufacturing facilities can be simplified, enhancing the positioning precision of masks and the positional precision of conductive layers can be enhanced.

Figure 24:
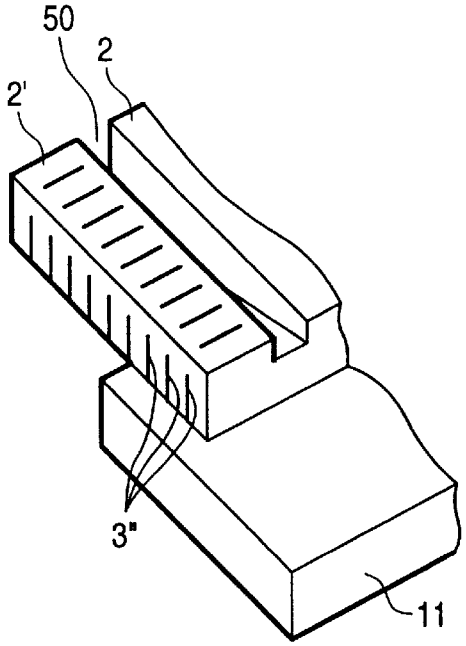
FIGS. 24(*a*) and 24(*b*), and 24(*c*) and 24(*d*) respectively show the other embodiment of a dummy piezoelectric vibrator and are enlarged views showing an internal electrode for connection formed in the dummy piezoelectric vibrator.
Figure 24:
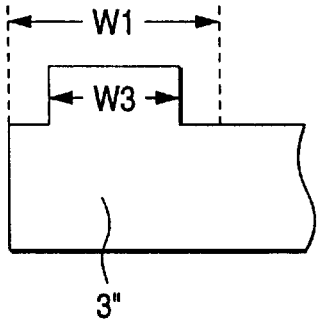
Figure 24:
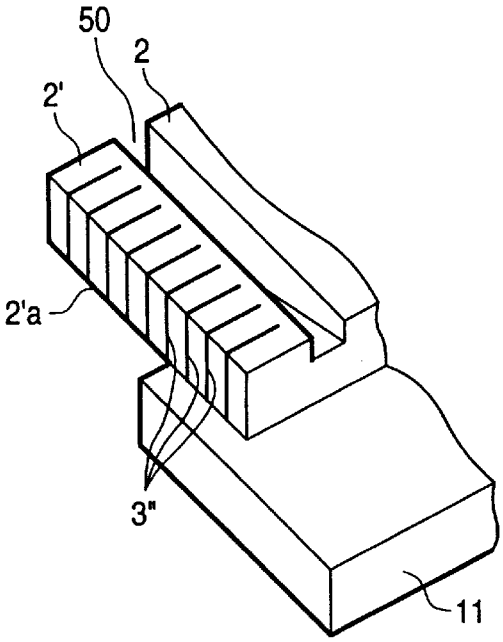
Figure 24:
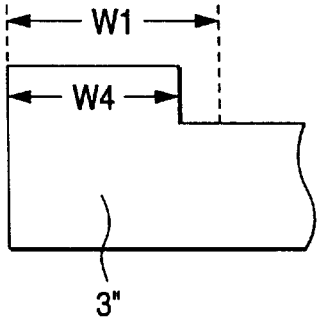

As the common internal electrode 3" formed in the dummy piezoelectric vibrator 2' has only to enable conduction between the conductive layer 8 formed on the side of the fixing substrate 11 and the conductive layer 10 formed on the other surface, the common internal electrode may be formed so that both ends thereof are exposed only in the center portion of the front and back faces of the dummy piezoelectric vibrator 2' by using a mask having a projection of width W3 smaller than the width W1 of the dummy piezoelectric vibrator 2' as shown in FIGS. 24(*a*) and 24(*b*). Alternatively, it may be formed so that the internal electrodes are exposed on the side face 2'*a* of the dummy piezoelectric vibrator 2' and located inside the groove 50 as shown in FIGS. 24(*c*) and 24(*d*).

Figure 25:
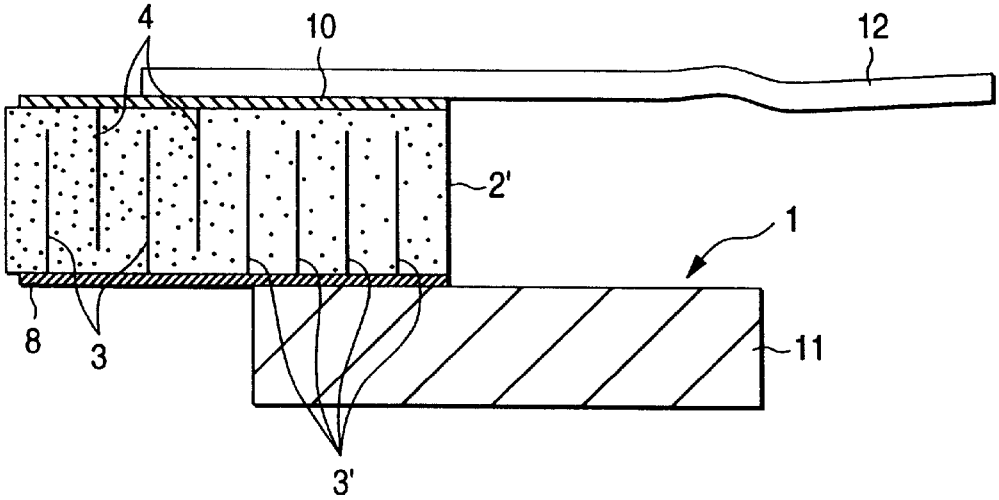
FIGS. 25(*a*) and 25(*b*) are respectively a sectional view and a top view showing connection structure between the piezoelectric vibrator unit and a signal supply member.
Figure 25:
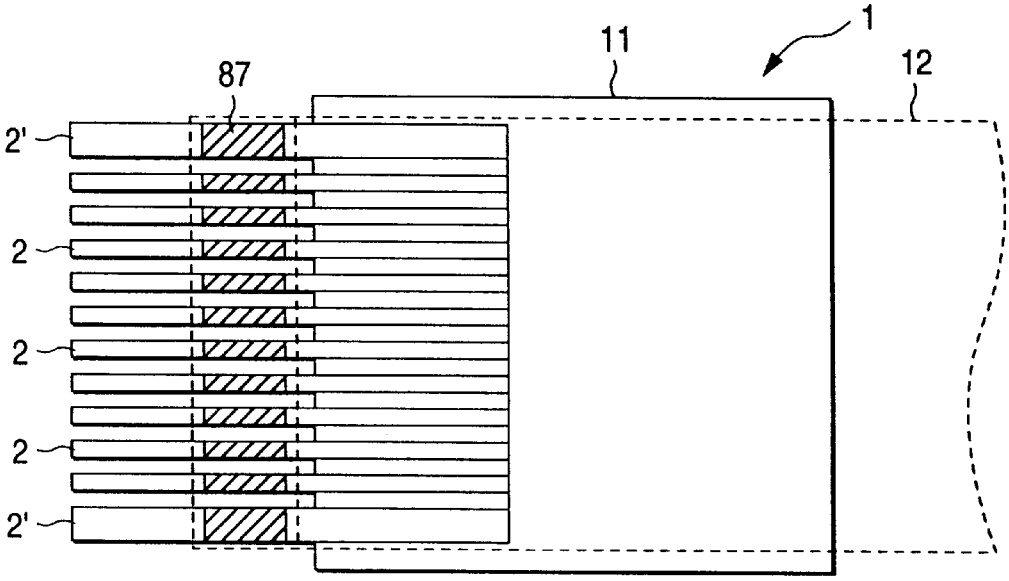

In the above embodiment, the flexible cable 12 which is a signal supply member, the piezoelectric vibrator 2 and the dummy piezoelectric vibrator 2' are joined in a joining area 87 formed on the side of the bottom end of the non-vibrational area and shown by hatching in FIG. 19(*b*). Alternatively, as the conductive layer 10 is formed from top end portion to the bottom end portion on the respective front faces of the piezoelectric vibrator for driving 2 and the dummy piezoelectric vibrator 2', the joining area 87 may be also provided in the vibrational area as shown in FIGS. 25(*a*) and 25(*b*) in a range in which the extension or contraction of the piezoelectric vibrator for driving 2 is not influenced. Therefore, the flexible cable 12 has only to be positioned with precision in width direction thereof and thereby the reliability of connection between the flexible cable 12 and the piezoelectric vibrator unit 1 can be readily secured.

Figure 26:
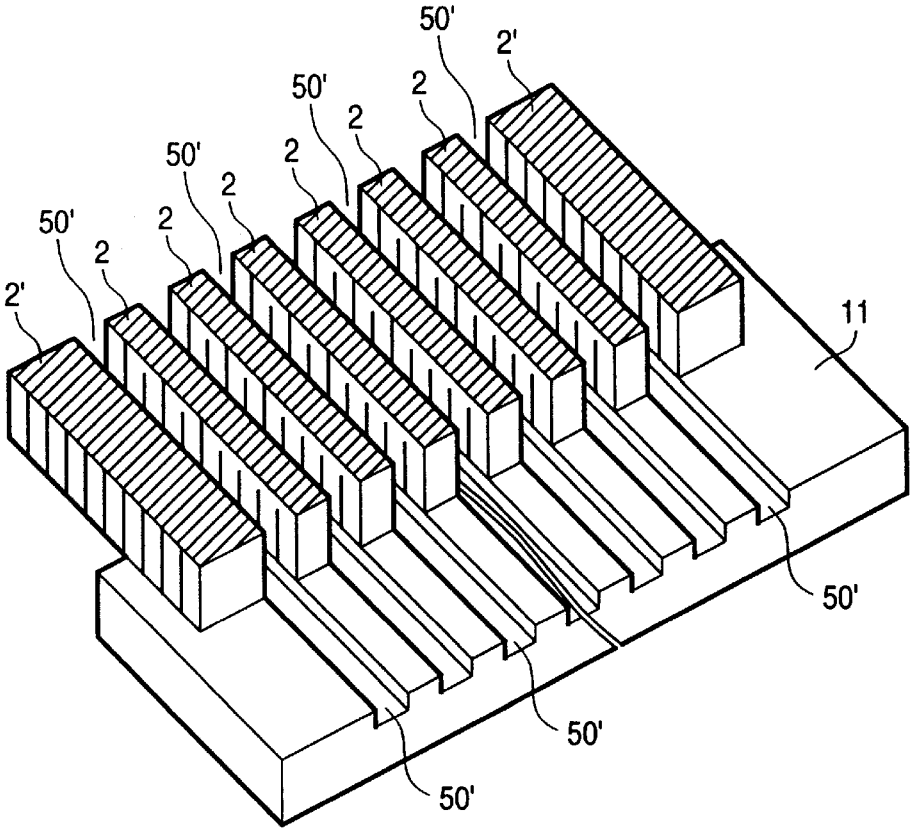
FIG. 26 is a perspective view showing another embodiment of cutting when one piezoelectric diaphragm is cut.

In the above embodiment, the grooves 50 the bottom portions 50*a* of which are slant are formed and the cutting is conducted so that all the piezoelectric vibrators for driving 2 and the dummy piezoelectric vibrators 2' are continuous via the bottom 50*a*. Alternatively, as shown in FIG. 26, even if the grooves 50' are formed so that adjacent piezoelectric vibrators 2 and 2' are completely parted, conduction between the common internal electrode of the piezoelectric vibrator for driving 2 and the conductive layer 10 of the dummy piezoelectric vibrator 2' can be secured if the fixing substrate 11 is formed by conductive material. That is, the common internal electrode respectively in the piezoelectric vibrator 2 and the dummy piezoelectric vibrator 2' maintains conduction via the conductive layer 8 and the fixing substrate 11.

According to the above configuration, not only precise cutting work is not required and the manufacturing process can be simplified by forming the bottom 50*a* of the groove 50 so that the bottom is slant but as each vibrator 2 and 2' is completely separated, interference between vibrators can be reduced.

Figure 27:
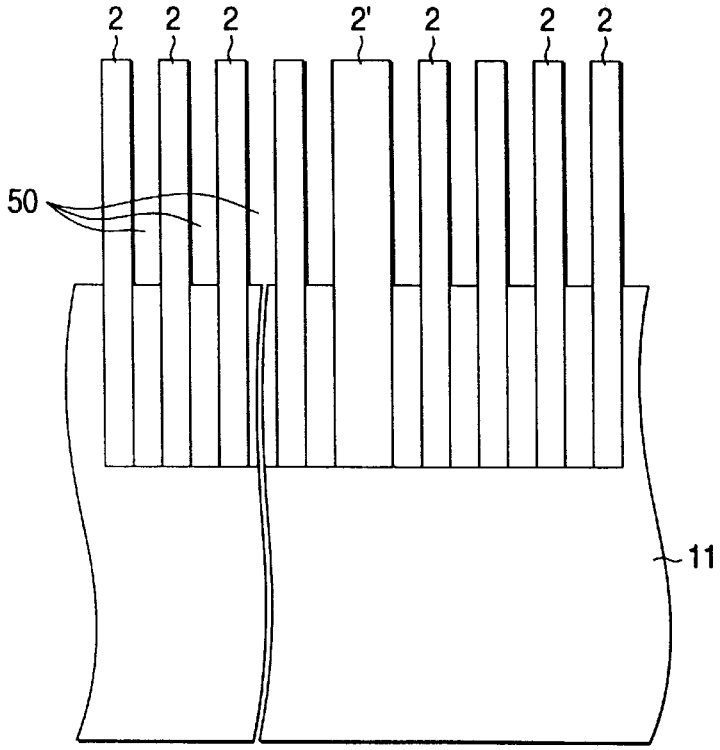
FIG. 27 is a front view showing a position in which a dummy piezoelectric vibrator is arranged.

Further, in the above embodiment, the dummy piezoelectric vibrators 2' are formed at both ends in a direction in which the piezoelectric vibrators for driving 2 are arrayed. Alternatively, as shown in FIG. 27, the dummy piezoelectric vibrator 2' may be also formed between the piezoelectric vibrators for driving 2 in a central area and others.

Figure 28:
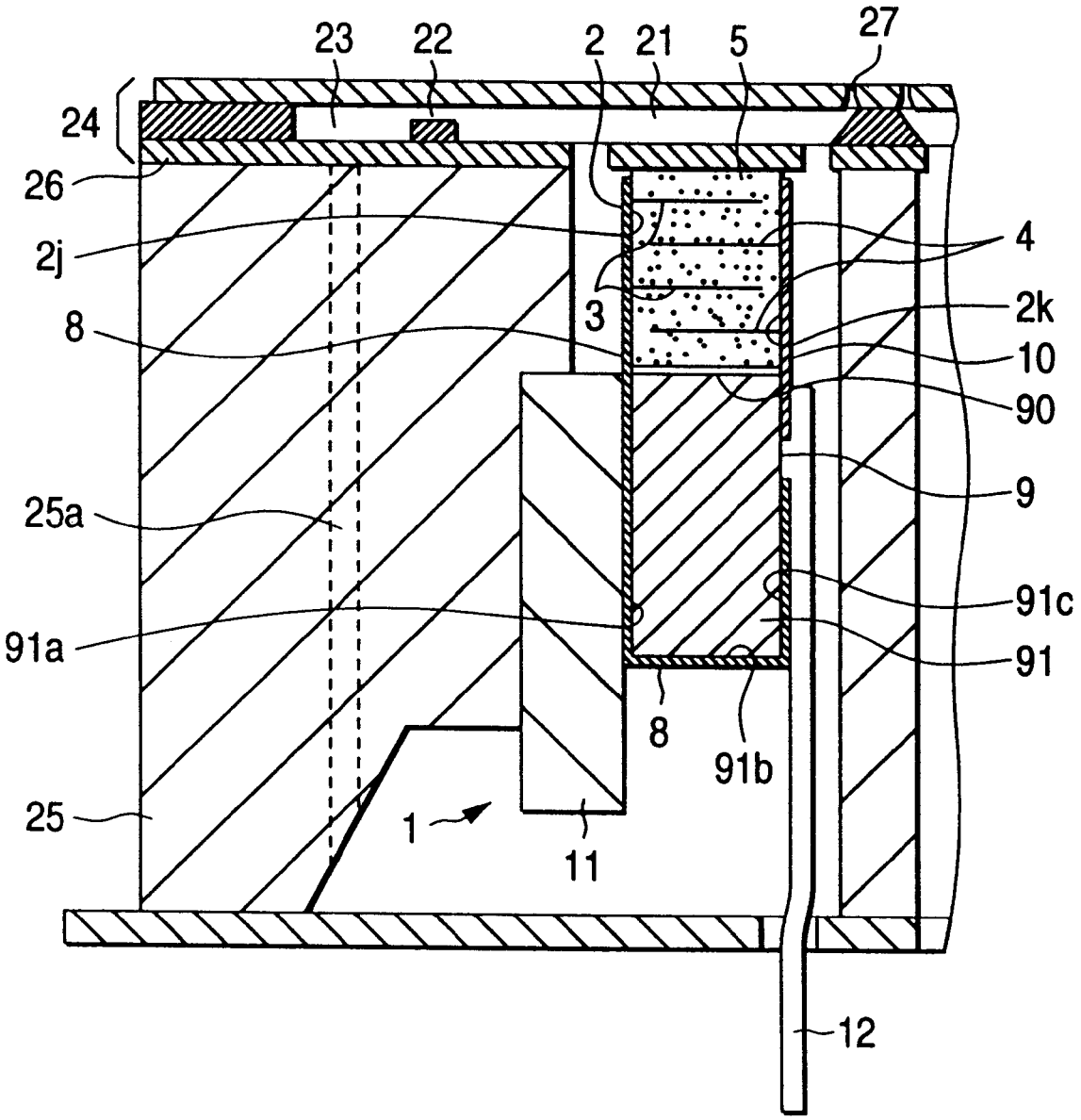
FIG. 28 is a sectional view showing another embodiment of the ink-jet recording head according to the present invention.
Figure 29:
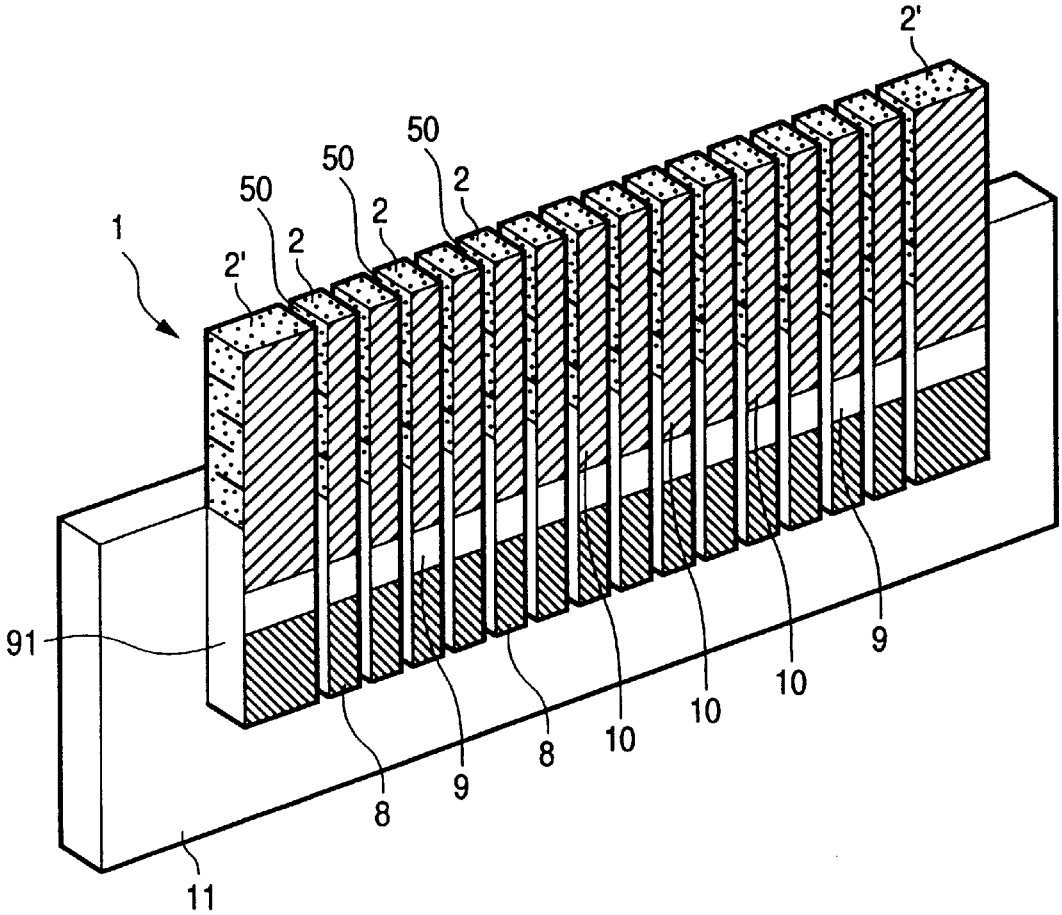
FIG. 29 is a perspective view showing an embodiment of a piezoelectric vibrator unit of the above recording head.
Figure 30A:
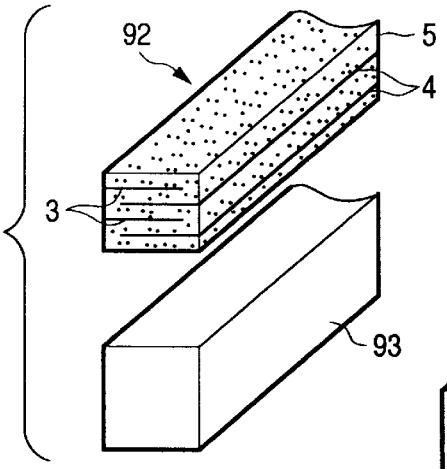
FIGS. 30 (*a*) to (*e*) respectively show an embodiment of a method of manufacturing the above piezoelectric vibrator unit.
Figure 30D:
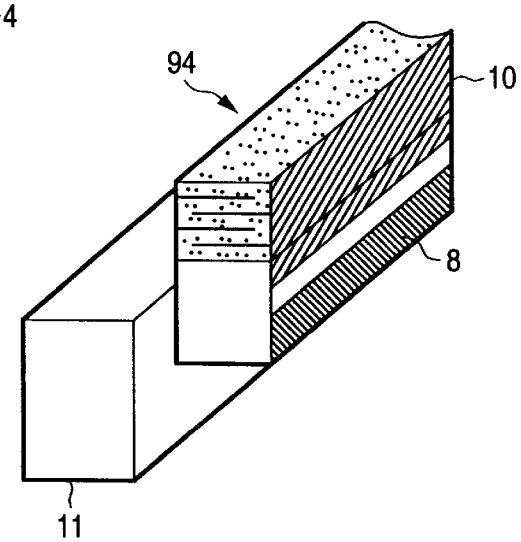
Figure 30B:
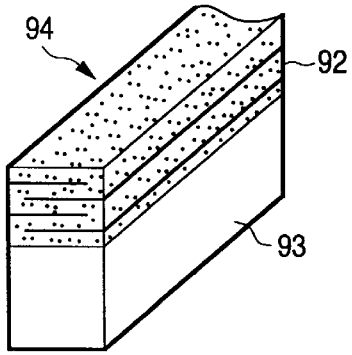
Figure 30E:
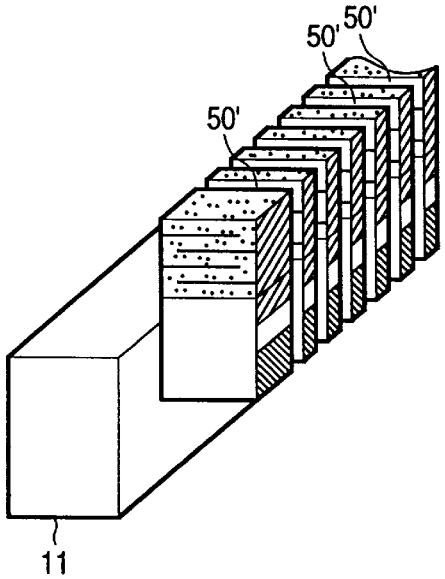
Figure 30C:
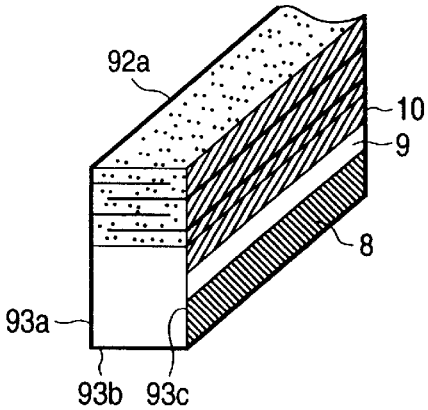

FIG. 28 shows another embodiment of the recording head using the piezoelectric vibrator unit according to the present invention, FIG. 29 shows another embodiment of the piezoelectric vibrator unit. In a piezoelectric vibrator unit 1, common internal electrodes 3 and individual internal electrodes 4 are provided with piezoelectric material 5 such that one end portions of the respective electrodes are exposed only one face of a front face and a back face of a piezoelectric vibrators 2 and respective electrodes are laminated so as to be wrapped with each other in a central area of the respective vibrator to constitute an active area. A substrate 91 which does not contribute to vibration is fixed through a bonding layer 90 at lower end portion of the respective vibrator are respectively exposed only on one side, a respectively wrapped in a central area are laminated in, an active part is formed and at the lower end.

A conductive layer 8 to be a common electrode extended from an internal electrode formed area to the way to the exposed surface 91*c* of the substrate 91 via the side face 91*a* and the bottom face 91*b* of the substrate 91 is formed on the back face 2*j* of the piezoelectric vibrator 2 on which the common internal electrode 3 is exposed and a conductive layer 10 to be an individual external electrode is formed on the front face 2*k* on which the individual internal electrode 4 is exposed so that fixed clearance 9 is formed between the conductive layer 10 and the above conductive layer 8.

As the side of the conductive layer 8 of the substrate 91 of the piezoelectric vibrator 2 is fixed to the fixing substrate 11 and the bonded face can be selected so that it is larger than the cross section of the bottom of the piezoelectric vibrator 2, the substrate is fixed at sufficient strength.

When the conductive pattern of the above flexible cable 12 is touched to the surface and fixed by soldering and others because the conductive layers 8 and 10 respectively having different poles are closely exposed on one surface, a driving signal can be supplied to the common internal electrodes 3 and 4 of the piezoelectric vibrator 2. A reference numeral 2' denotes a dummy piezoelectric vibrator respectively arranged at both ends in a direction in which the piezoelectric vibrators 2 are arrayed.

To manufacture such a piezoelectric vibrator unit 1, there are provided a piezoelectric vibration block 92 in which the common internal electrode 3 and the individual internal electrode 4 are wrapped in a central area and laminated in the piezoelectric material 6 so that each is exposed only at one of a front face and a back face; and a substrate 93 provided with approximately the same thickness as the piezoelectric block 92 and composed of material which does not contribute to vibration as shown in FIG. 30(*a*). Then a bottom surface of the piezoelectric vibration block 92 and a top surface of the substrate 93 are fixed by an adhesive to be integrated structure 94 as shown in FIG. 30(*b*).

Next, the conductive layer 8 is formed on the face on which the common internal electrode 3 is exposed so as to extend from an internal electrode exposed surface 92*a* to the way of a front face 93*c* via the back face 93*a* and a bottom face 93*b* of the substrate 93, and the conductive layer 10 is formed on the face on which the individual internal electrode 4 is exposed such that fixed clearance 9 is provided between the conductive layer 8 on the substrate 92 as shown in FIG. 30(*c*).

After the back face 93*a* of the substrate 93 is fixed to the fixing substrate 11 as shown in FIG. 30(*d*), The above groove 50 or the groove 50' is formed by a dicing cutter or a wire saw so that the piezoelectric block 92 and the conductive layer 10 formed only on one surface are divided and at least the piezoelectric vibration block 92 is cut in the form of the teeth of a comb, the piezoelectric vibrator unit is completed as shown in FIG. 30(*e*).

If the displacement is fixed, force $F_p$ generated by the piezoelectric vibrator 2 is proportional to Young's modulus $E_p$. As the quantity of ink in an ink droplet jetted from an individual nozzle aperture 27 is proportional to the quantity of the displacement of an elastic plate 26 composing a pressure generating chamber 21, the displacement of the piezoelectric vibrator 2 is required to be efficiently related to the displacement of the elastic plate 26.

Therefore, the quantity of deformation by force $F_p$ generated by the substrate 91 for supporting the other end of the piezoelectric vibrator 2 is required to be reduced.

As the vibrational cycle $T_p$ which is a large factor in determining the jetted speed of an ink droplet of the piezoelectric vibrator 2 is proportional to $\sqrt{E_p/\rho_p}$, where $E_p$ is Young's modulus of the piezoelectric vibrator 2 and $\rho_p$ is the specific gravity, it is desirable that the acoustic impedance $\rho_{b1}C_{b1}$ (where, $\rho_{b1}$ is the specific gravity of the substrate 91 and $C_{b1}$ is the acoustic velocity in the substrate 91) of the substrate 91 touched to the piezoelectric vibrator 2 for supporting is more than the acoustic impedance $\rho_p C_p$ ($\rho_p$ shows the specific gravity of the piezoelectric vibrator 2 and $C_p$ shows the acoustic velocity in the piezoelectric vibrator 2) of the piezoelectric vibrator 2 so as to secure the jetted speed of an ink droplet.

As the acoustic impedance of material is provided with positive correlation with Young's modulus, it is desirable that the material of the substrate 91 is selected so that $\rho_{b1}E_{b1} \geqq \rho_p E_p$ is satisfied, where Young's modulus of the substrate 7 is $E_{b1}$ and Young's modulus of the piezoelectric vibrator is $E_p$.

In the concrete, as the specific gravity of the piezoelectric vibrator 2 is $7.9\times10^3$ (kg/m$^3$) and its Young's modulus is $6.5\times10^{10}$ (pa), the product of these is $5.14\times10^{14}$ (kgN/m$^5$).

In the meantime, for material which meets the above relationship, $\rho_{b1}E_{b1} \geqq \rho_p E_p$, ceramic material the specific gravity of which is $3\times10^3$ (kg/m$^3$), Young's modulus of which is $2.4\times10^{10}$ (Pa) and the product of which is $7.2\times10^{14}$ (kgN/m$^5$) exists. As the ceramic material is provided with insulation performance, it is also provided with a function for preventing the conductive layers 8 and 10 from being short-circuited. However, as the hardness of ceramic material is higher, compared with that of another material and it is fragile, there is a defect that the cutting work is difficult.

In the meantime, metallic material excellent in workability is conductive and the conductive layers 8 and 10 may be short-circuited as it is, however, as for metallic material, the specific gravity is $8.12\times10^3$ (kg/m$^3$), Young's modulus is $2.14\times10^{10}$ (Pa) and the product is $17.2\times10^{14}$ (kgN/m$^5$), metallic material is extremely excellent substrate composition material if an insulating film and others are formed on the surface and insulation processing is executed.

When piezoelectric vibrators are arrayed in accordance with pitch between nozzle apertures, adjacent piezoelectric vibrators interfere with each other, and the quantity of ink in an ink droplet jetted corresponding to a printing signal from an individual nozzle aperture 27 and the jetted speed are varied.

However, the above problem can be solved by selecting a thing which meets relationship that the multiplier of the material of the fixing substrate 11 is $\rho_{b2}E_{b2} \geqq \rho_p E_p$ ($\rho_{b2}$ shows the specific gravity of the fixing substrate 11 and $E_{b2}$ shows Young's modulus of the fixing substrate) such as metal.

Figure 31:
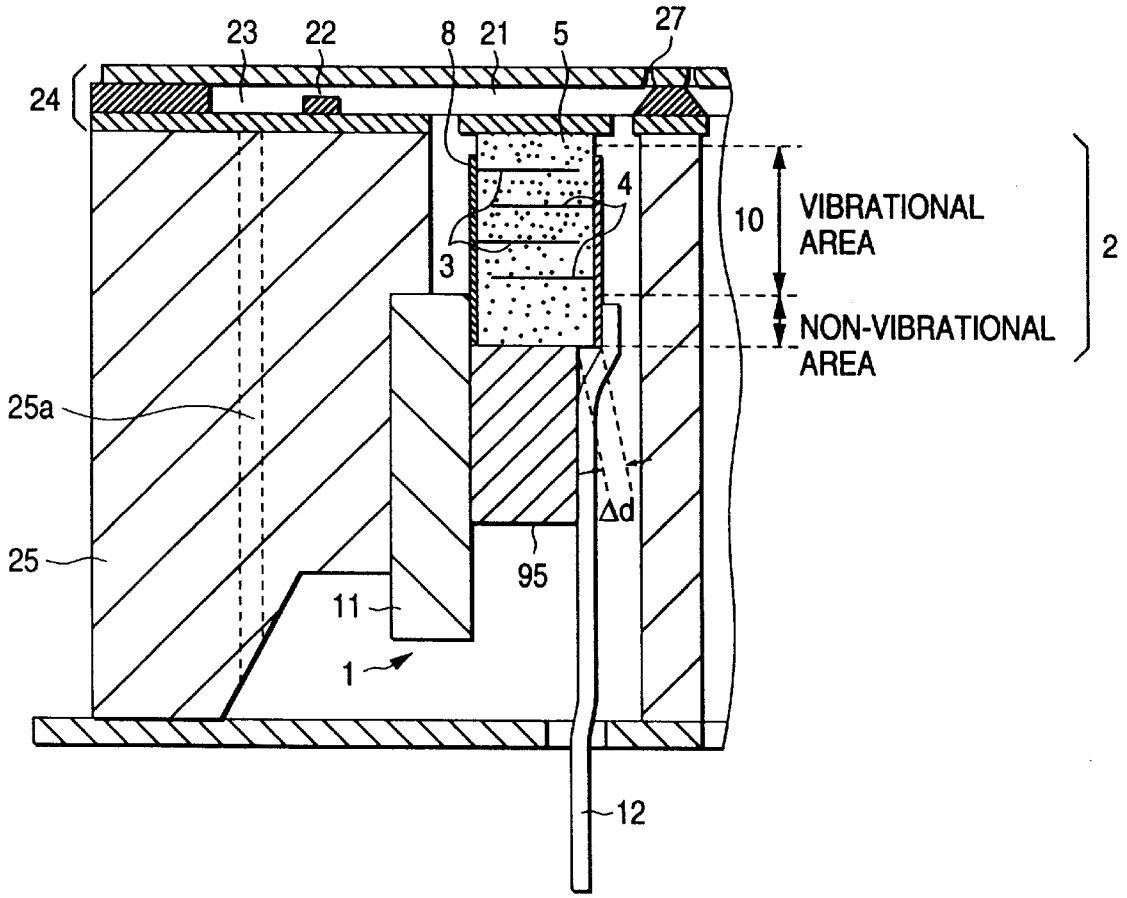
FIG. 31 is a sectional view showing the other embodiment of the ink-jet recording head according to the present invention.
Figure 32:
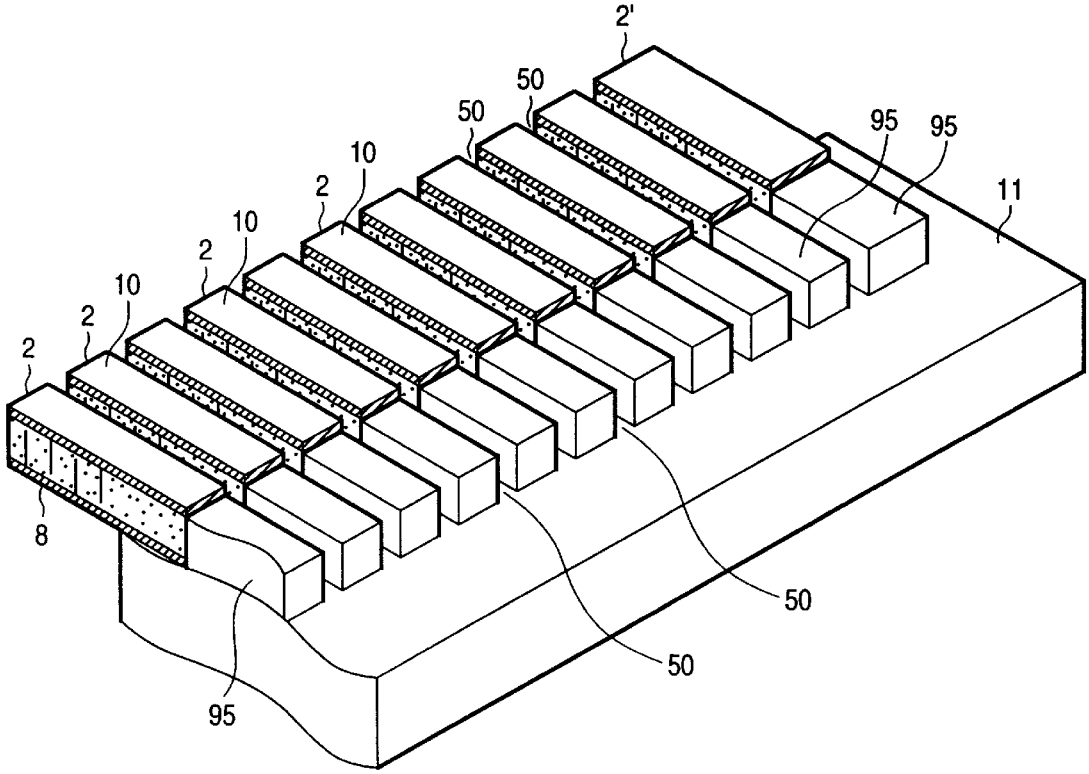
FIG. 32 is a perspective view showing a piezoelectric vibrator unit used for the above recording head.

FIGS. 31 and 32 show another embodiment of the present invention and a piezoelectric vibrator 2 is constituted so that plural common internal electrodes 3 and plural individual internal electrodes 4 which are alternately laminated together with piezoelectric material 5 so as to be wrapped in a central area of the vibrator and one end portions of the respective electrodes are exposed only on one of a front face and back face. A slight non-vibrational area is formed at a bottom portion of the vibrator.

A conductive layer 8 and a conductive layer 10 are respectively formed on the surfaces on which the common internal electrodes 3 and the individual internal electrodes 4 are exposed so as to extend to the non-vibrational area.

A lower portion of the back face of the non-vibrational area of the piezoelectric vibrator 2 is conductivity fixed to a fixing substrate 11 composed of conductive material, desirably metal or ceramics to the surface of which conducting processing is applied. A reinforcing piece 95 composed of conductive material such as metal or ceramics to the surface of which conducting processing is applied is touched to the bottom face of the piezoelectric vibrator 2 such that the reinforcing piece 95 is brought into contact with the bottom end of the conductive layer 8 to be a common external electrode and fixed to the fixing substrate 11.

In a piezoelectric vibrator unit 1 constituted as described above, the above conductive pattern 19 shown in FIG. 3 is connected to the conductive layer 10 as an individual external electrode on the surface and the pattern of a flexible cable 12 is connected to the fixing substrate 11 or the reinforcing piece 95. Hereby, when a driving signal is supplied to the piezoelectric vibrator from an external driving circuit not shown via the flexible cable 12, each piezoelectric vibrator 2 is axially extended and contracts and expands and contracts a pressure generating chamber 21. Hereby, ink in a reservoir 23 flows into the pressure generating chamber 21 via an ink supply port 22, the pressure generating chamber is pressurized in predetermined time and ink in the pressure generating chamber is jetted from a nozzle aperture 27 as an ink droplet.

In the piezoelectric vibrator unit 1 in this embodiment, as material other than piezoelectric material can be also selected for the reinforcing piece 95 as well as the substrate 91 in the above embodiment, metal and others the mass of which is larger than that of piezoelectric material and the rigidity of which is high can be used, can be sufficiently resistant to reactive force when the pressure generating chamber 21 is pressurized and the pressure generating chamber 21 can be efficiently compressed.

Next, referring to FIG. 33, a method of manufacturing the above piezoelectric vibrator unit will be described.

Figure 33A:
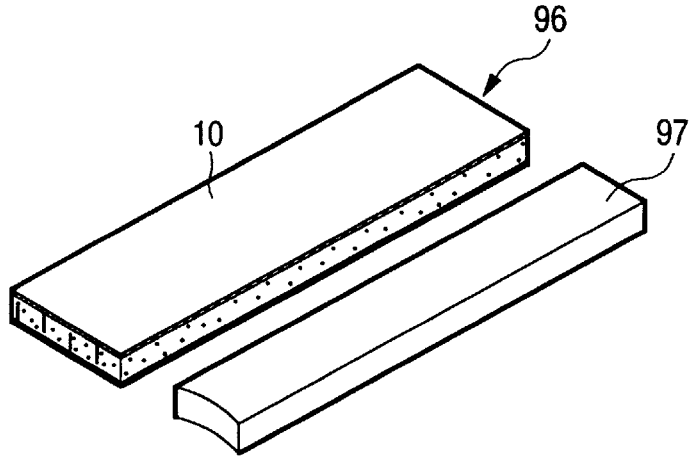
FIGS. 33(*a*) to (*c*) respectively show a method of manufacturing the above piezoelectric vibrator unit.
Figure 33B:
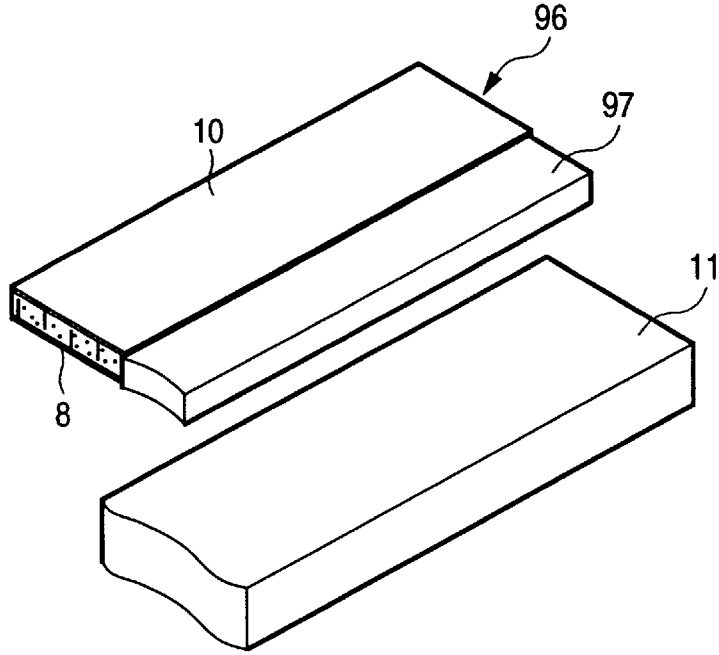
Figure 33C:
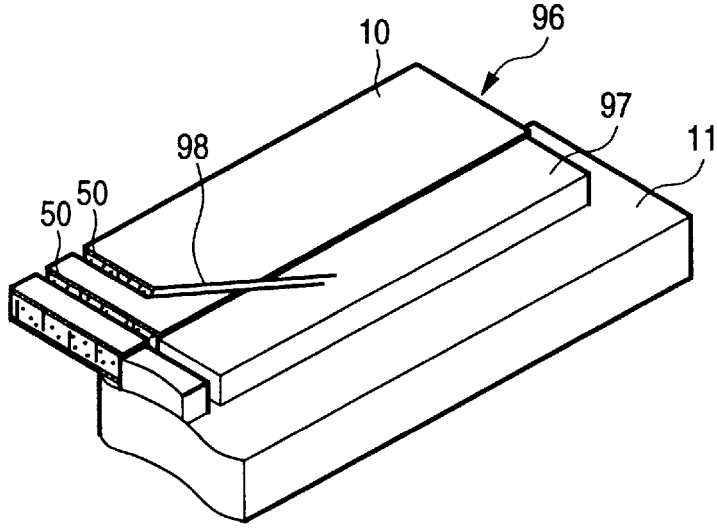

There are provided a piezoelectric diaphragm 96 in which the common internal electrode 3 and the individual internal electrode 4 which are alternately laminated with piezoelectric material 5 between both internal electrodes such that one end portions of the respective electrodes are exposed only on one of a front face and a back face and the respective electrodes are wrapped in a central area to constitute an active area, in which a slight non-vibrational area is formed on a lower end portion, and in which the conductive layers 8 and 10 are formed from the surfaces on which the internal electrodes 3 and 4 are respectively exposed to the bottom end; and a plate 97 composed of conductive material such as metal or ceramics to the surface of which conducting processing is applied, which is to be the reinforcing piece 95 as shown in FIG. 33(*a*).

The plate 97 is bonded to the piezoelectric diaphragm 96 so as to conductivity contact with the conductive layer 8 as shown in FIG. 33(*b*). Both are fixed so that at least the conductive layer 10 in the non-vibrational area of the piezoelectric diaphragm 96 and the fixing substrate 11 are electrically connected. Then the groove 50 is formed by a wire saw 98 and others in accordance with the width of the piezoelectric vibrator 2 and the dummy piezoelectric vibrator 2' to be formed as shown in FIG. 33(*c*).

Figure 34:
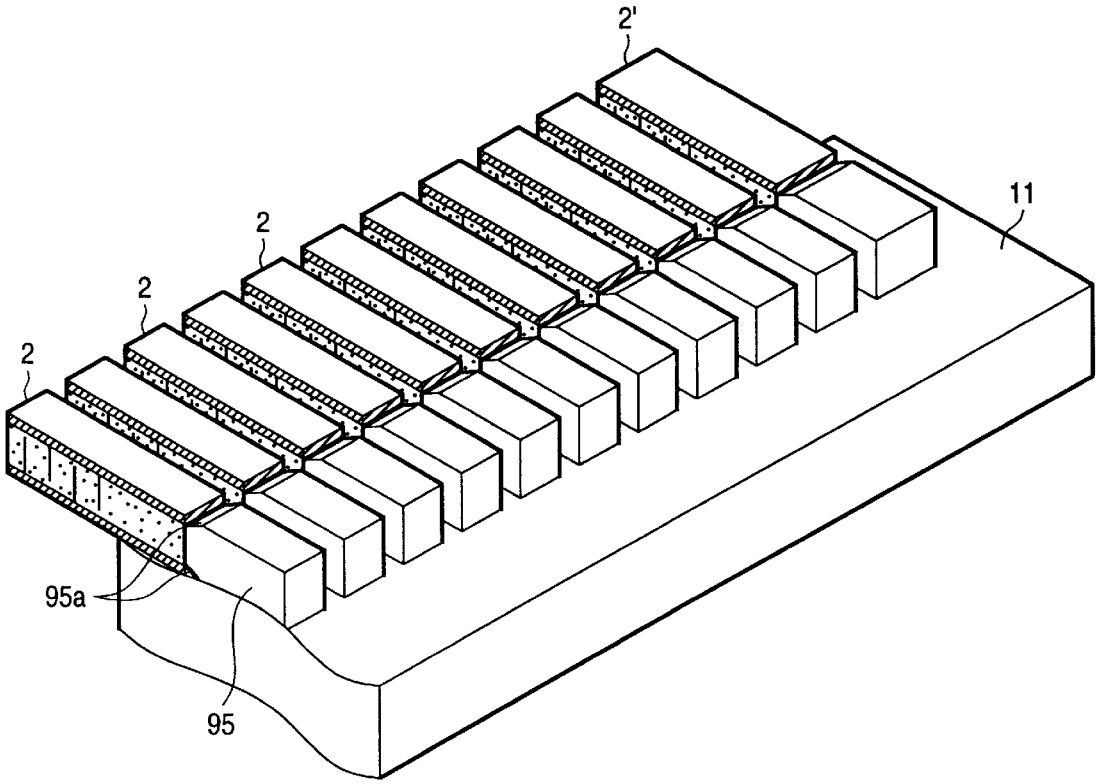
FIGS. 34, 35 and 36 are respectively perspective views showing the other embodiment of the above piezoelectric vibrator unit.
Figure 35:
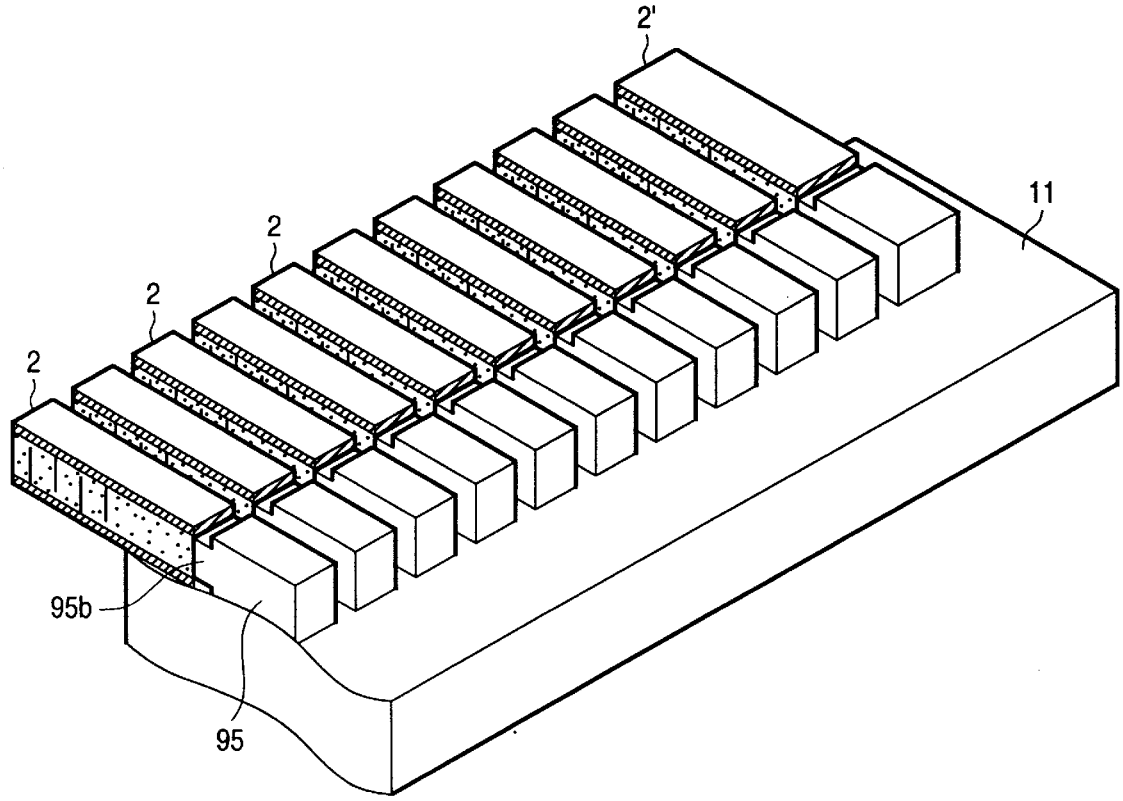

In the above embodiment, the reinforcing piece 95 and the conductive layer 10 to be an individual external electrode for connection are prevented from being short-circuited by forming the reinforcing piece 95 so that the thickness is thinner than that of the piezoelectric vibrator. Alternatively, as shown in FIG. 34, a slant notch 95*a* may be also formed or as shown in FIG. 35, a convex portion 95*b* may be also formed.

According to this embodiment, if the fixing substrate 11 has only to be formed by conductive material, while the conductive relationship between the common internal electrode 3 and the fixing substrate 11 via the conductive layer 8 at the back side of the piezoelectric vibrator 2 can be obtained, restriction against both of the front and back faces of the vibrational area can be reduced. Therefore, elastic deformation is enabled in this area and the efficiency of displacement by the piezoelectric vibrator can be enhanced.

Figure 36:
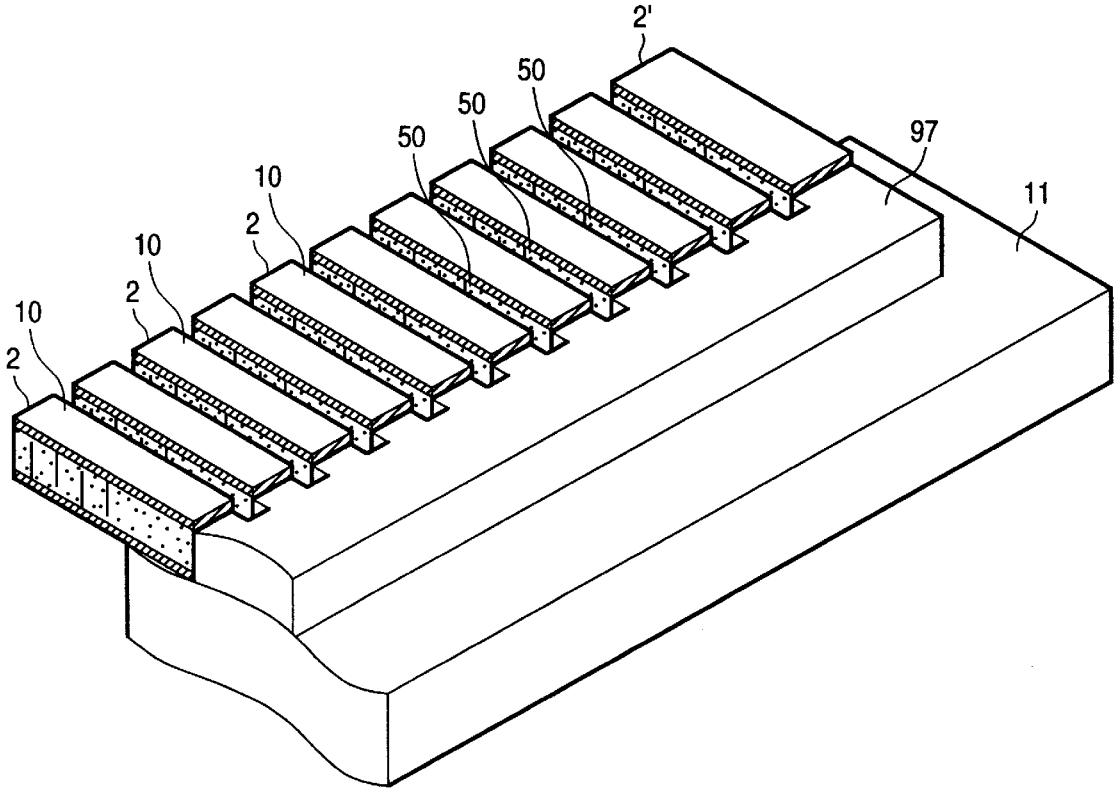

Further, in the above embodiment, an individual reinforcing piece 95 is separated every piezoelectric vibrator 2. Alternatively, as shown in FIG. 36, the groove 50 may be also formed to a position to extent that the conductive layer 10 to be an individual external electrode for connection at least in the vibrational area can be separated between piezoelectric vibrators in the reinforcing plate 97. According to this embodiment, as the reinforcing plate 97 is provided with a continuous area, an area in which the piezoelectric vibrator is bonded to the fixing substrate 11 can be extended and joining electrical resistance between the reinforcing plate 97 and the fixing substrate can be reduced.

INDUSTRIAL APPLICABLITY

According to the present invention, as the plural piezoelectric vibrators including the vibrational area in which the common internal electrodes and the individual internal electrodes are laminated so that they are wrapped in a central area in a displacement direction thereof with piezoelectric material between both internal electrodes and one end portions of the respective electrodes are exposed only on one of the side faces; and the non-vibrational area are fixed to the fixing substrate at one side face thereof, a bonding area larger than the cross section of the piezoelectric vibrator can be secured and the piezoelectric vibrator can be fixed to the fixing substrate in predetermined bonding strength.

As the piezoelectric vibrator also includes a first conductive area which conducts both of common internal electrode which is exposed on the side of the fixing substrate and the front face of the piezoelectric vibrator via the conductive material and a second conductive area formed on the front face of the piezoelectric vibrator to conduct to the individual internal electrode, a cable for supplying a driving signal can be connected to one surface on the side on which the piezoelectric vibrator is not fixed and work for connecting the cable can be simplified.

What is claimed is:

1. A piezoelectric vibrator unit comprising:

a plurality of piezoelectric vibrators back faces of which are secured to a fixing substrate, each of the piezoelectric vibrator including a non-vibrational area and a vibrational area in which a common internal electrode and an individual internal electrode are laminated in a displacement direction thereof together with a piezoelectric material sandwiched therebetween so as to be wrapped in a central area thereof and such that one end portion of the common internal electrode is exposed on the back face and one end portion of the individual electrode is exposed on a front face thereof;

a first conductive layer conducting to the each common internal electrode and extending to the each front face of the respective piezoelectric vibrators; and a second conductive layer conducting to the each individual internal electrode and formed on the each front face of the respective piezoelectric vibrators.

2. The piezoelectric vibrator unit as set forth in claim 1, wherein the each first conductive layer is formed so as to extend via a bottom portion of the non-vibrational area and makes a predetermined clearance with respect to the second conductive layer.

3. The piezoelectric vibrator unit as set forth in claim 1, wherein at least a part of the each first conductive layer is secured to the fixing substrate.

4. The piezoelectric vibrator unit as set forth in claim 1, wherein a step portion is formed in the fixing substrate, and a bottom face and a back face adjoining to the bottom face of the each non-vibrational area are secured to the step portion.

5. The piezoelectric vibrator unit as set forth in claim 1, wherein a back face of the fixing substrate is formed so as to be in parallel with the back face of the each piezoelectric vibrator, and a top face of the each piezoelectric vibrator is formed so as to be perpendicular to the back face of the fixing substrate.

6. The piezoelectric vibrator unit as set forth in claim 1, wherein at least the vibrational areas of the each piezoelectric vibrators are formed by dividing a piezoelectric vibrator diaphragm with a groove.

7. The piezoelectric vibrator unit as set forth in claim 1, wherein the piezoelectric vibrators are formed by dividing a piezoelectric vibrator diaphragm with a groove such that a part of the first conductive layers formed on the respective piezoelectric vibrator constitute a continuous area.

8. The piezoelectric vibrator unit as set forth in claim 1 further comprising:

a dummy piezoelectric vibrator provided in at least one end portion of an array of the piezoelectric vibrators and not related to a jetting of ink droplets.

9. The piezoelectric vibrator unit as set forth in claim 8, wherein a width of the dummy piezoelectric vibrator is wider than a width of the piezoelectric vibrators.

10. The piezoelectric vibrator unit as set forth in claim 1, wherein the non-vibrational area of the each piezoelectric vibrator is made of a piezoelectric material.

11. The piezoelectric vibrator unit as set forth in claim 10, wherein a groove extending in a direction of which the piezoelectric vibrators are array is formed on a boundary between the vibrational area and the non-vibrational area on the each front face of the piezoelectric vibrator.

12. The piezoelectric vibrator unit as set forth in claim 10, wherein a cross section of the each non-vibrational area is smaller than a cross section of the each vibrational area.

13. The piezoelectric vibrator unit as set forth in claim 10, wherein a slant face is formed on a boundary between the each vibrational area and the each non-vibrational area.

14. The piezoelectric vibrator unit as set forth in claim 1, wherein the piezoelectric vibrators are made of a piezoelectric diaphragm in which the first conductive layer is formed on a back face thereof and the second conductive layer is formed on a front face thereof, and the piezoelectric vibrators are formed by cutting with a groove separating at least the second conductive layer and an area to be the vibrational area.

15. The piezoelectric vibrator unit as set forth in claim 1, wherein the piezoelectric vibrators are made of a piezoelectric diaphragm in which the first conductive layer is formed on a part of a back face thereof and the second conductive layer is formed on a front face thereof and extended to the front face so as to make a predetermined clearance with respect to the first conductive layer, and the piezoelectric vibrators are formed by cutting with a groove separating at least the second conductive layer and an area to be the vibrational area.

16. The piezoelectric vibrator unit as set forth in one of claim 14 and claim 15, wherein a bottom portion of the groove is a slant face in which one end thereof on the side of the fixing substrate is closer to a free end of the each piezoelectric vibrator.

17. The piezoelectric vibrator unit as set forth in claim 1, wherein the non-vibrational area of the each piezoelectric vibrator is made of an anti-piezoelectric material.

18. The piezoelectric vibrator unit as set forth in claim 17, wherein $\rho_{b1}E_{b1} \geqq \rho_p E_p$ is satisfied, where $\rho_{b1}$ is the specific gravity of the anti-piezoelectric material, $E_{b1}$ is the Young's modulus of the same, $\rho_p$ is the specific gravity of the piezoelectric material constituting the vibrational area, and $E_p$ is the Young's modulus of the same.

19. The piezoelectric vibrator unit as set forth in claim 17, where the anti-piezoelectric material is an insulative material.

20. The piezoelectric vibrator unit as set forth in claim 17, where the anti-piezoelectric material is a conductive material secured to the fixing substrate through the conductive layer and an insulative film.

21. The piezoelectric vibrator unit as set forth in claim 17, wherein $\rho_{b2}E_{b2} \geqq \rho_p E_p$ is satisfied, where $\rho_{b2}$ is the specific gravity of the fixing substrate, $E_{b2}$ is the Young's modulus of the same, $\rho_p$ is the specific gravity of the piezoelectric material constituting the vibrational area, and $E_p$ is the Young's modulus of the same.

22. The piezoelectric vibrator unit as set forth in claim 1, wherein the vibrational area of the piezoelectric vibrator is formed by cutting a piezoelectric diaphragm with a groove extending from a top end of the diaphragm to where the second conductive layer can be parted.

23. An ink-jet recording head comprising:

a pressure generating means served by the piezoelectric vibrator unit as set forth in claim 1.

24. A piezoelectric vibrator unit comprising:

a plurality of piezoelectric vibrators back faces of which are secured to a fixing substrate, each of the piezoelectric vibrator including a non-vibrational area and a vibrational area in which a common internal electrode and an individual internal electrode are laminated in a displacement direction thereof together with a piezoelectric material sandwiched therebetween so as to be wrapped in a central area thereof and such that one end portion of the common internal electrode is exposed on the back face and one end portion of the individual electrode is exposed on a front face thereof; and a dummy piezoelectric vibrator back face of which are secured to the fixing substrate, the dummy piezoelectric vibrator including internal connection electrodes at least one portion of which is exposed on the back face and a front face thereof.

25. The piezoelectric vibrator unit as set forth in claim 24, wherein the internal connection electrodes are provided at least in that area of the dummy piezoelectric vibrator is secured to the fixing substrate.

26. The piezoelectric vibrator unit as set forth in claim 24, wherein the internal connection electrodes are provided at a predetermined pitch which is the same as a provided pitch of the internal electrodes in the piezoelectric vibrator.

27. The piezoelectric vibrator unit as set forth in claim 24, wherein the internal connection electrodes conduct to all the non-vibrational areas of the piezoelectric vibrators.

28. The ink jet recording head as set forth in claim 27, wherein the signal supply member is a flexible cable.

29. The piezoelectric vibrator unit as set forth in claim 24, wherein the internal connection electrodes conduct to a conductive layer formed on the front face of the dummy piezoelectric vibrator.

30. The piezoelectric vibrator unit as set forth in claim 24, wherein the internal connection electrodes are made of the same material as of the internal electrodes of the piezoelectric vibrator.

31. The piezoelectric vibrator unit as set forth in claim 24, wherein the piezoelectric vibrators and the dummy piezoelectric vibrator are made of a piezoelectric diaphragm in which a conductive layer is formed on a front face and a back face thereof, and the piezoelectric vibrators and the dummy piezoelectric vibrator are formed by cutting with a groove separating at least the conductive layer and an area to be the vibrational area.

32. The piezoelectric vibrator unit as set forth in claim 31, wherein a bottom portion of the groove is a slant face in which one end thereof on the side of the fixing substrate is closer to a free end of the each piezoelectric vibrator.

33. The piezoelectric vibrator unit as set forth in claim 29, wherein the groove is formed so as to part the piezoelectric diaphragm and the conductive layer formed on the back face thereof.

34. The piezoelectric vibrator unit as set forth in claim 24, wherein the fixing substrate has a conductivity in that area the piezoelectric vibrator is secured to.

35. A piezoelectric vibrator unit comprising:

a plurality of piezoelectric vibrators each of which include a vibrational area in which a common internal electrode and an individual internal electrode are laminated in a displacement direction thereof together with a piezoelectric material sandwiched therebetween so as to be wrapped in a central area thereof and such that one end portion of the common internal electrode is exposed on a back face thereof and one end portion of the individual electrode is exposed on a front face thereof, and a non-vibrational area forming member made of a conductive material and joined to the vibrational area; and a fixing substrate to which a back face of the non-vibrational area forming member is secured to conduct the common internal electrode with the non-vibrational area forming member.

36. The piezoelectric vibrator unit as set forth in claim 35, wherein the each common internal electrode conducts with the non-vibrational area forming member via a conductive layer formed externally.

37. The piezoelectric vibrator unit as set forth in claim 35 further comprising:

a conductive layer is formed on the front face of the each piezoelectric vibrator to conduct to the each individual internal electrode.

38. The piezoelectric vibrator unit as set forth in claim 35, wherein the vibrational area of the piezoelectric vibrator is formed by dividing a piezoelectric diaphragm with a groove extending from a top end of the diaphragm to where the conductive layer can be parted.

39. The piezoelectric vibrator unit as set forth in claim 35, wherein $\rho_{b1}E_{b1} \geqq \rho_p E_p$ is satisfied, where $\rho_{b1}$ is the specific gravity of the non-vibrational area forming member, $E_{b1}$ is the Young's modulus of the same, $\rho_p$ is the specific gravity of the piezoelectric material constituting the vibrational area, and $E_p$ is the Young's modulus of the same.

40. The piezoelectric vibrator unit as set forth in claim 35, wherein $\rho_{b2}E_{b2} \geqq \rho_p E_p$ is satisfied, where $\rho_{b2}$ is the specific gravity of the fixing substrate, $E_{b2}$ is the Young's modulus of the same, $\rho_p$ is the specific gravity of the piezoelectric material constituting the vibrational area, and $E_p$ is the Young's modulus of the same.

41. The piezoelectric vibrator unit as set forth in claim 35, wherein a thickness of the non-vibrational area forming member is thinner than a thickness of the vibrational area.

42. An ink jet recording head comprising:

a piezoelectric vibrator unit including:

a fixing substrate;

a plurality of piezoelectric vibrators secured to the fixing substrate, each of the piezoelectric vibrators including a non-vibrational area and a vibrational area in which common internal electrodes and individual internal electrodes are laminated in a displacement direction thereof together with a piezoelectric material sandwiched therebetween so as to be wrapped in a central area thereof;

a first conductive area formed on a first side face of the piezoelectric vibrator unit for conducting to the common internal electrodes; and a second conductive area formed on the first side face of the piezoelectric vibrator unit for conducting to the individual internal electrodes;

a flow passage unit including a pressure generating chamber communicating with a nozzle opening and a reservoir and being pressurized by the respective piezoelectric vibrators; and a signal supplying member connected to the first and the second conductive areas for supplying a driving signal to the piezoelectric vibrator unit.

43. The ink-jet recording head as set forth in claim 42, wherein the piezoelectric vibrator unit includes at least one dummy piezoelectric vibrator, and the first conductive area is formed on the dummy piezoelectric vibrator.

44. The ink-jet recording head as set forth in claim 42, wherein the first conductive area is constituted by the fixing substrate, and the fixing substrate has a conductivity at least in a surface thereof.

45. The ink-jet recording head as set forth in claim 42, wherein the piezoelectric vibrator unit includes at least one dummy piezoelectric vibrator, and the first conductive area is constituted by a conductive layer conducting to an internal connection electrode formed in the dummy piezoelectric vibrator.

* * * * *